US008733003B2

(12) United States Patent
Bowman et al.

(10) Patent No.: US 8,733,003 B2
(45) Date of Patent: May 27, 2014

(54) FILE FOLDER ASSEMBLIES, DIVIDER, AND SLIDABLE TAB

(75) Inventors: Vincent H. Bowman, Highland Park, IL (US); Jeffrey Herz, Aliso Viejo, CA (US); Jay K. Sato, Mission Viejo, CA (US); Weiye Wu, Donguan (CN)

(73) Assignee: Avery Products Corporation, Strongville, OH (US)

( * ) Notice: Subject to any disclaimer, the term of this patent is extended or adjusted under 35 U.S.C. 154(b) by 50 days.

(21) Appl. No.: 13/245,791

(22) Filed: Sep. 26, 2011

(65) Prior Publication Data

US 2013/0074381 A1 Mar. 28, 2013

(51) Int. Cl.
*G09F 23/10* (2006.01)
*B42F 21/06* (2006.01)

(52) U.S. Cl.
CPC ..... *B42F 21/06* (2013.01)
USPC ..... 40/641; 40/359

(58) Field of Classification Search
USPC ..... 40/359, 641; 229/67.2; 283/37, 41
See application file for complete search history.

(56) References Cited

U.S. PATENT DOCUMENTS

| | | | | |
|---|---|---|---|---|
| 1,923,197 | A * | 8/1933 | Freiberg | 40/395 |
| 2,664,089 | A * | 12/1953 | Meltzer | 40/651 |
| 3,204,639 | A | 9/1965 | Kleffman | |
| 5,118,137 | A | 6/1992 | Walters | |
| 5,140,727 | A | 8/1992 | Dais et al. | |
| 5,141,485 | A | 8/1992 | Welt | |
| 5,174,606 | A | 12/1992 | Hure | |
| 5,235,731 | A | 8/1993 | Anzai et al. | |
| 5,311,685 | A | 5/1994 | Wyant | |
| 5,722,128 | A | 3/1998 | Toney et al. | |
| 5,941,450 | A | 8/1999 | De Safey | |
| 5,996,881 | A | 12/1999 | Smith | |
| 6,248,050 | B1 | 6/2001 | Boy | |
| 6,375,604 | B1 | 4/2002 | Verhines | |
| 6,409,409 | B2 | 6/2002 | Bauman et al. | |
| 6,453,589 | B1 | 9/2002 | Schwartz | |
| 6,607,122 | B1 | 8/2003 | Ong | |
| 6,732,461 | B2 | 5/2004 | Slattery et al. | |
| 7,125,050 | B2 | 10/2006 | Yamamoto et al. | |

(Continued)

FOREIGN PATENT DOCUMENTS

| | | |
|---|---|---|
| DE | 1960254 | 5/1967 |
| EP | 122380 | 10/1984 |
| JP | 10217664 | 8/1998 |

OTHER PUBLICATIONS http://www.nxtbook.com/nxtbooks/safeguard/healthcare_2009spring//index.php?startid=4#6.

(Continued)

*Primary Examiner* — Kristina Junge
(74) *Attorney, Agent, or Firm* — McDonald Hopkins LLC

(57) ABSTRACT

A file folder assembly or divider with a tab capable of being slid in two non-collinear directions. According to one embodiment, the file folder assembly includes a file folder and a sliding tab assembly. The sliding tab assembly includes a rail secured to the file folder proximate to a top edge of the file folder. The sliding tab assembly also includes a tab and a coupling member. The coupling member couples the tab to the rail in such a way as to permit the tab to be slid horizontally back and forth along the rail and/or to permit the tab to be slid vertically up and down relative to the rail.

28 Claims, 27 Drawing Sheets

(56) References Cited

U.S. PATENT DOCUMENTS

| | | | |
|---|---|---|---|
| D560,719 | S | 1/2008 | Wehmeyer |
| 7,334,363 | B1 | 2/2008 | Hansen |
| 7,383,652 | B2 | 6/2008 | Glasberg |
| 7,389,598 | B2 | 6/2008 | Bunger et al. |
| D602,524 | S | 10/2009 | Wong et al. |
| D608,390 | S | 1/2010 | Wong et al. |
| D608,391 | S | 1/2010 | Wong et al. |
| 7,731,442 | B2 | 6/2010 | Barausky et al. |
| D637,229 | S | 5/2011 | Hicks et al. |
| 2003/0126779 | A1 | 7/2003 | Sato et al. |
| 2004/0208400 | A1 | 10/2004 | Linneweil |
| 2005/0093290 | A1 | 5/2005 | Richied |
| 2006/0076771 | A1 | 4/2006 | Schafer |
| 2006/0225322 | A1 | 10/2006 | O'Leary et al. |
| 2006/0226204 | A1 | 10/2006 | O'Leary et al. |
| 2007/0119082 | A1 | 5/2007 | Gilchrist |
| 2007/0234601 | A1 | 10/2007 | Yoo et al. |
| 2008/0257940 | A1 | 10/2008 | Busam |
| 2009/0133305 | A1 | 5/2009 | Calistri et al. |
| 2009/0178320 | A1 | 7/2009 | Goodfellow et al. |
| 2010/0116872 | A1 | 5/2010 | Kent et al. |
| 2010/0326865 | A1 | 12/2010 | Maistrellis |
| 2011/0084119 | A1 | 4/2011 | Zapalac |

OTHER PUBLICATIONS http://www.amazon.com/Smead-Project-Organizer-Pockets-89200/dp/B001CE8IVG/ref=sr_1_1?ie=UTF8&qid=1315511047&sr=8-1.

* cited by examiner

FILE FOLDER ASSEMBLIES, DIVIDER, AND SLIDABLE TAB

FIELD OF THE INVENTION

The present invention relates generally to file folders and relates more particularly to file folder assemblies of the type including a file folder and a tab slidably mounted on the file folder.

BACKGROUND

Documents are often loosely stored in receptacles known as file folders. One common type of file folder, which is also frequently referred to as a hinged folder or a manila folder, typically includes a sheet of cardstock or similar material that has been folded approximately in half about a fold line to define hingedly interconnected front and rear panels. Opening or closing of a manila folder can be effected by appropriately pivoting one or both panels about the fold line. Another common type of file folder, which is also frequently referred to as a pocket folder, typically includes a sheet of cardstock or similar material that has been folded and adhered to itself to define a hollow member including a front wall, a rear wall, a left wall, a right wall, a bottom wall, and an open top. The bottom wall and the side walls of a pocket folder can be pleated to permit expansion of the pocket folder, for example, when in use or to permit compaction of the pocket folder, for example, during storage. Still another common type of file folder, which is frequently referred to as a hanging file folder, is similar in construction to a manila folder but additionally includes hooks or similar mounting structures extending laterally from the front and rear panels to permit the file folder to be hung from a pair of rails within a file cabinet or the like.

It is frequently advantageous for a person to be able to identify the contents of a file folder without actually having to examine the contents of the file folder. For this reason, many file folders are equipped with a tab on which identifying indicia can be placed. In the case of manila folders, such a tab is typically integrally formed with the rear panel and extends either upwardly relative to the top edge of the front panel or laterally relative to a side edge of the front panel. As can readily be appreciated, one difficulty that is frequently encountered with tabbed manila folders is that when such folders are aligned with one another, the indicia on one tab is obscured from view by the tab that is positioned in front of it. One approach to this problem has been to provide a plurality of tabbed manila folders whose tabs are staggered at different locations along the top edge of the rear panel. Unfortunately, however, this approach fails to significantly ameliorate the problem where the number of arranged files greatly exceeds the number of different tab positions.

In the case of hanging file folders, the tab is typically a separately-formed structure that is coupled to a top edge of the file folder. In one type of arrangement, the tab is fixedly mounted on a top edge of the file folder. However, as can be appreciated, hanging file folders that have fixedly mounted tabs suffer from many of the same types of shortcomings discussed above in connection with tabbed manila folders. Accordingly, in another type of arrangement, a tab is slidably mounted on the hanging file folder, the tab being slidably mounted on the top edge of the file folder so as to be horizontally movable along the top edge of the file folder. In this manner, by sliding the tab on the file folder as needed, one can typically position the tab for better viewing. Examples of such horizontally movable tabs on hanging file folders are disclosed in the following documents, all of which are incorporated herein by reference in their entireties: U.S. Pat. No. 5,311,685, inventor Wyant, issued May 17, 1994; U.S. Pat. No. 7,334,363, inventor Hansen, issued Feb. 26, 2008; U.S. Pat. No. 7,383,652, inventor Glasberg, issued Jun. 10, 2008; U.S. Pat. No. 7,389,598, inventors Bunger et al., issued Jun. 24, 2008. Still another type of tab used with hanging file folders is a tab that is slidably mounted on the file folder so as to be vertically movable relative to the top edge of the file folder. In this manner, by raising the tab on the file folder as needed, one can typically position the tab for better viewing. An example of such a vertically movable tab on a hanging file folder is disclosed in U.S. Patent Application Publication No. US 2007/0119082 A1, inventor Gilchrist, published May 31, 2007, which is incorporated herein by reference in its entirety.

Although slidable tabs of the types described above provide some measure of improvement in facilitating the viewing of indicia on such tabs, such improvement tends to diminish as the number of file folders increases and the availability of unobscured horizontal or vertical positions is exhausted.

Thus, there is a need for a file folder assembly including a file folder and a slidably mounted tab on the file folder wherein the slidably mounted tab can be placed in a wider range of possible positions.

SUMMARY

A novel file folder assembly including a file folder and a slidable tab mounted on the file folder that addresses at least some of the shortcomings associated with existing file folders and existing file folder assemblies including a slidable tab. According to one aspect of the invention, there is provided a file folder assembly that includes (a) a file folder, the file folder having an edge, and (b) a tab slidably disposed on the edge in a plurality of directions, at least two of the plurality of directions being non-collinear with respect to one another. An example of two such non-collinear directions is a horizontal direction and a vertical direction.

According to another aspect of the invention, there is provided a file folder assembly that includes (a) a file folder and (b) a sliding tab assembly coupled to the file folder, the sliding tab assembly including (i) a rail fixedly mounted on the file folder, the rail including an elongated slot, the elongated slot extending in a first direction, (ii) a tab, the tab including at least one elongated slot extending in a second direction, and (iii) a coupling member, the coupling member including a first post, the first post being inserted through both the elongated slot in the rail and the elongated slot in the tab, the coupling member further including enlargements on opposite ends of the first post dimensioned to retain the first post in the elongated slot in the rail and in the elongated slot in the tab.

According to yet another aspect of the invention, there is provided a file folder assembly that includes (a) a file folder and (b) a sliding tab assembly coupled to the file folder, the sliding tab assembly including (i) a first elongated strap extending in a first direction, the first elongated strap having a first end, a second end, and an intermediate portion, the first and second ends of the first elongated strap being fixed to the file folder, the intermediate portion of the first elongated strap not being fixed to the file folder, (ii) a coupling member, the coupling member including a second elongated strap and a first plurality of parallel slots, the second elongated strap extending in a second direction different than the first direction of the first elongated strap, the first elongated strap being woven through the first plurality of parallel slots of the coupling member in such a way as to permit the coupling member to slide along the first elongated strap, and (iii) a tab, the tab including a second plurality of parallel slots, the second elongated strap of the coupling member being woven through the second plurality of parallel slots of the tab in such a way as to permit the tab to slide along the second elongated strap.

According to still yet another aspect of the invention, there is provided a divider, the divider including (a) a sheet, the sheet having at least one transverse opening; and (b) a tab slidably disposed on the sheet in a plurality of directions, at least two of the plurality of directions being non-collinear with respect to one another. An example of two such non-collinear directions is a horizontal direction and a vertical direction.

For purposes of the present specification and claims, unless otherwise specified, the term "plurality" is defined to mean "two or more."

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention. Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention can be made without departing from the spirit thereof, and the invention includes all such modifications.

BRIEF DESCRIPTION OF THE DRAWINGS

The inventive subject matter disclosed herein can take form in various components and arrangements of components, and in various steps and arrangements of steps. The drawings are only for purposes of illustrating preferred embodiments and are not to be construed as limiting. Further, it is to be appreciated that the drawings may not be to scale.

DETAILED DESCRIPTION

Figure 1:
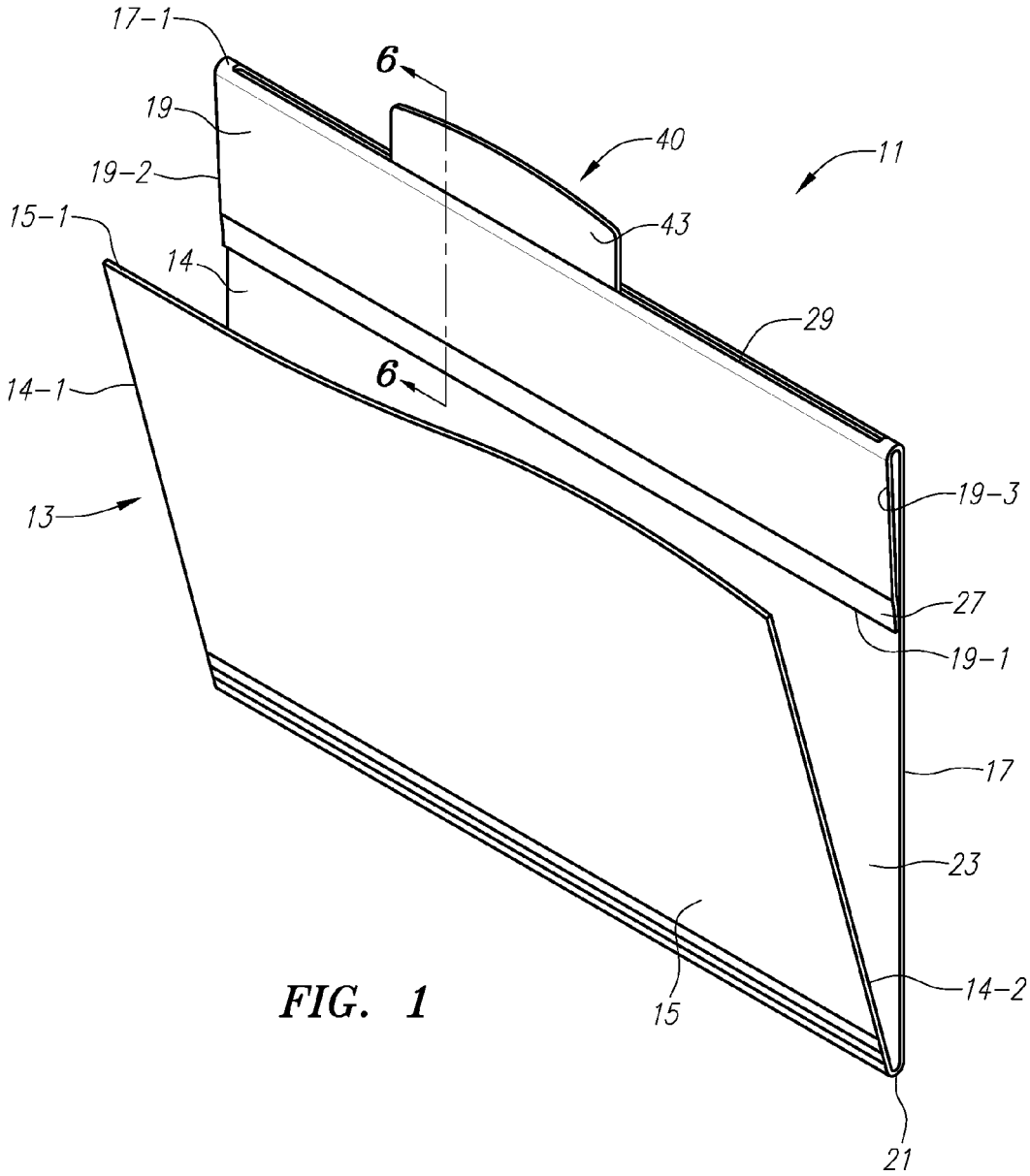
FIG. 1 is a front perspective view of a first embodiment of a file folder assembly constructed according to the present invention, the file folder assembly being shown with the file folder in a slightly opened state and with a slidable tab positioned in a first position.
Figure 2:
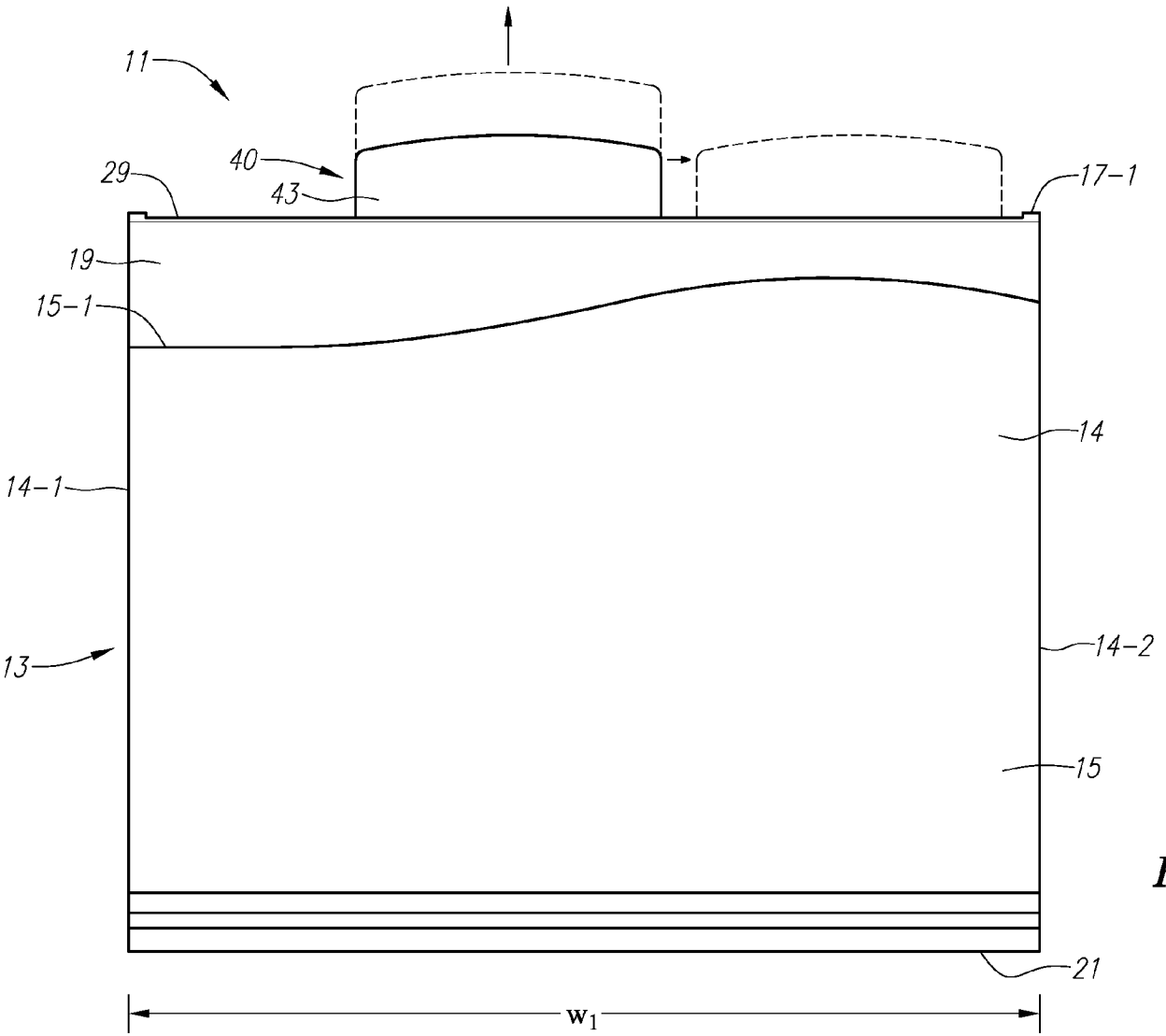
FIG. 2 is a front elevational view of the file folder assembly shown in FIG. 1, with the file folder being shown in a closed state and with exemplary alternative horizontal and vertical positions of the slidable tab being shown in phantom.
Figure 3:
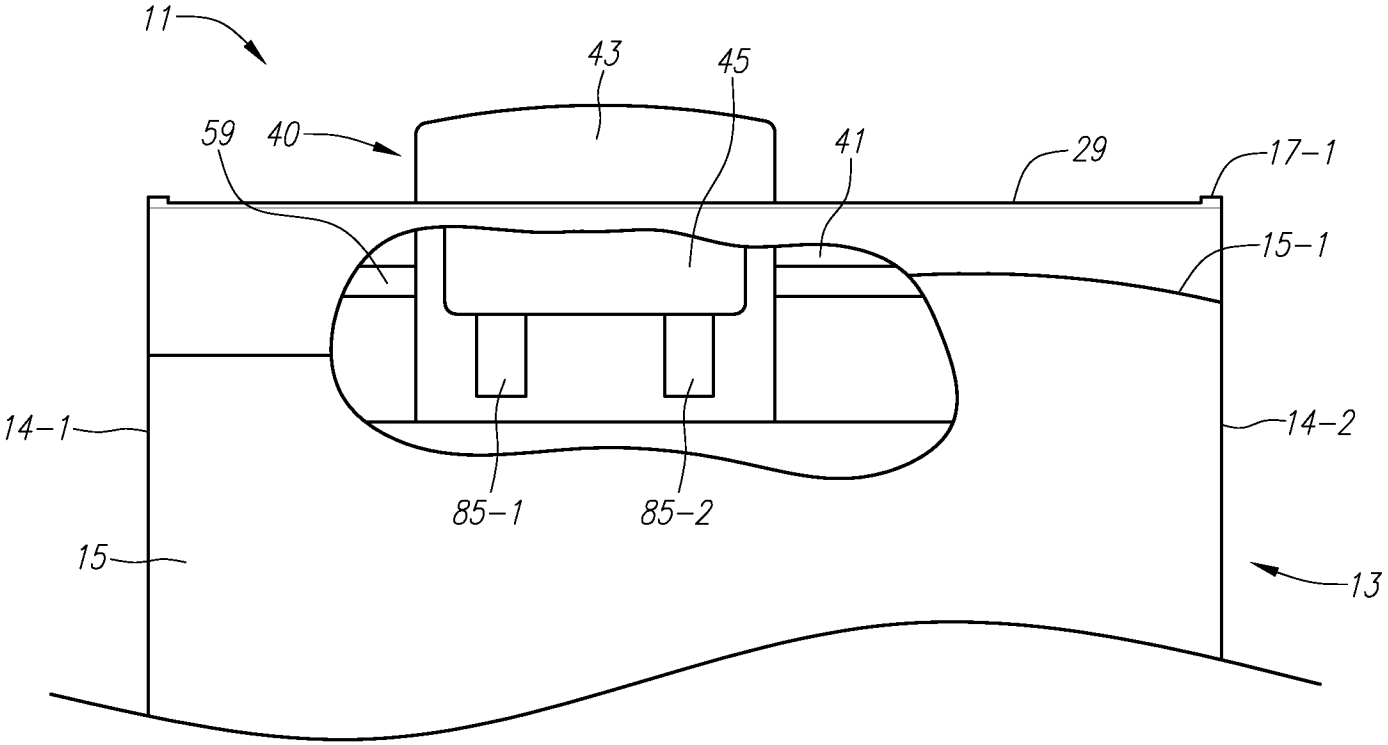
FIG. 3 is an enlarged fragmentary front elevational view, broken away in part, of the file folder assembly shown in FIG. 2.
Figure 4:
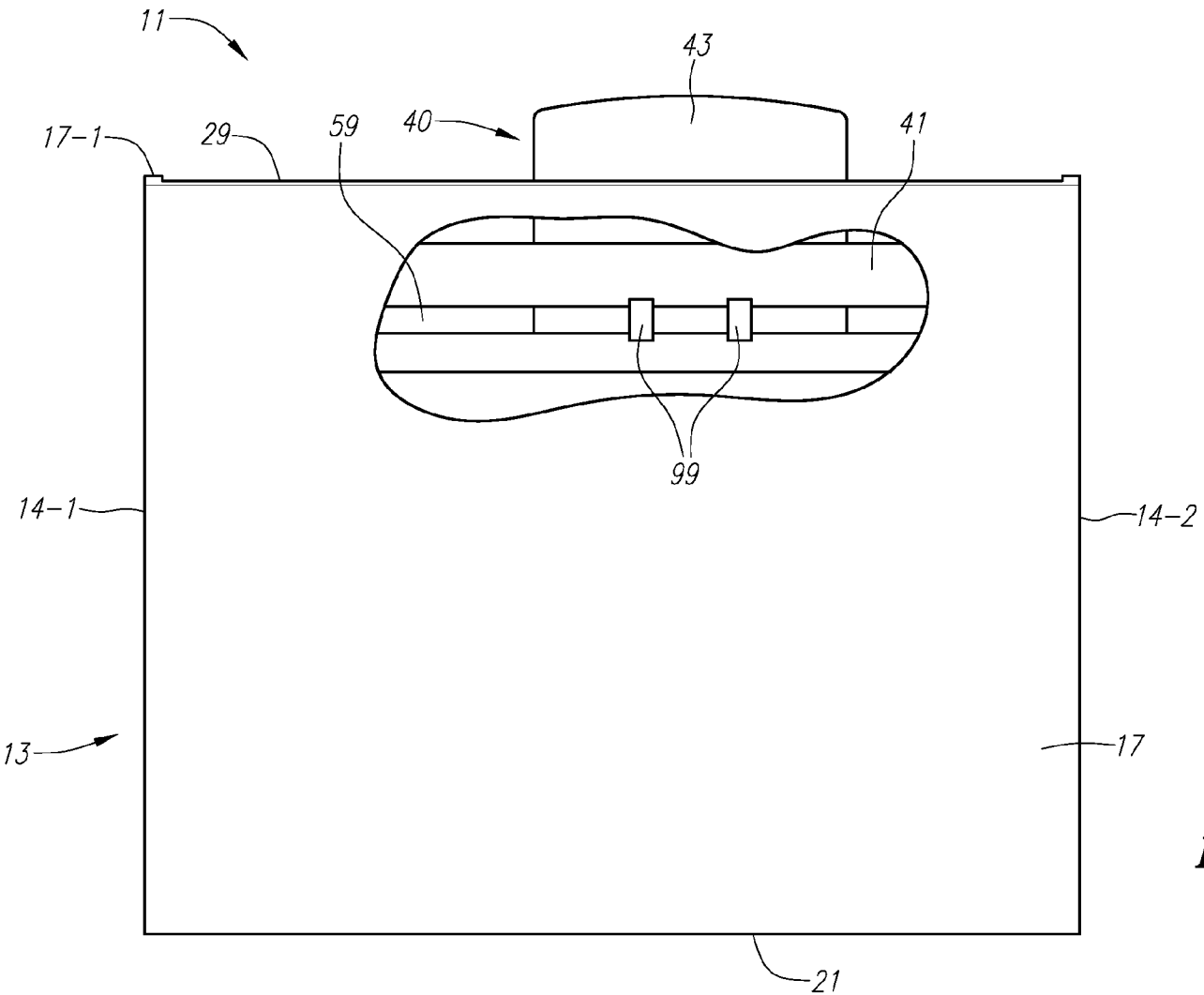
FIG. 4 is a rear elevational view, broken away in part, of the file folder assembly shown in FIG. 2.
Figure 5:
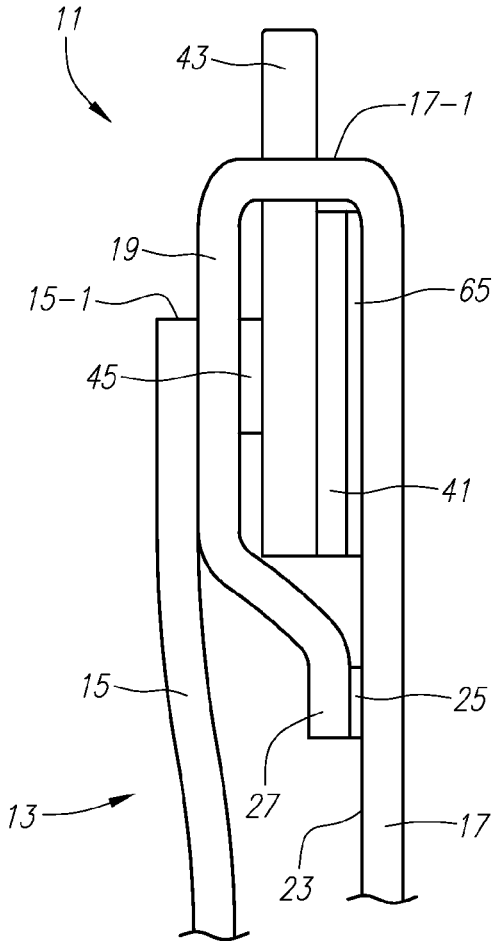
FIG. 5 is an enlarged fragmentary right-side elevational view of the file folder assembly shown in FIG. 2.
Figure 6:
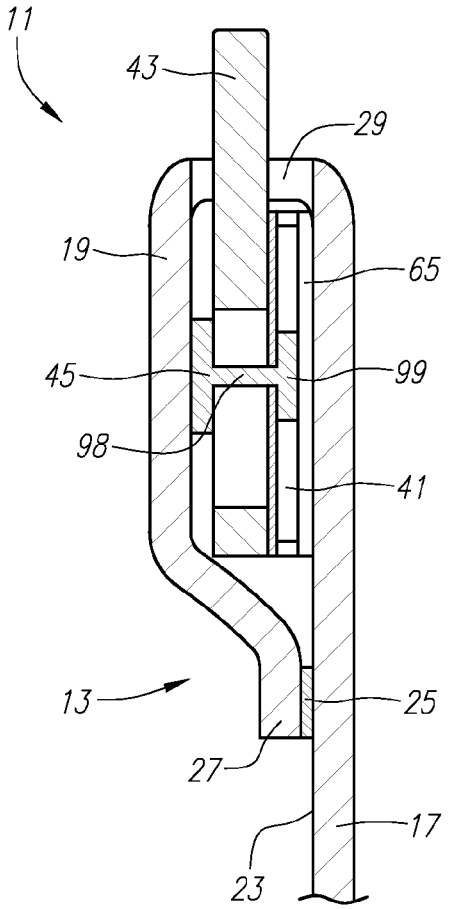
FIG. 6 is a section view of the file folder assembly of FIG. 1 taken along line 6-6.

The apparatuses, products, and methods disclosed in this document are described in detail by way of examples and with reference to the figures, which are not necessarily drawn to scale. Unless otherwise specified, like numbers in the figures indicate references to the same, similar, or corresponding elements throughout the figures. For clarity and simplicity, the present specification shall refer to structural and/or functional elements, relevant standards and/or protocols, and other components that are commonly known in the art without further detailed explanation as to their configuration or operation except to the extent they have been modified or altered in accordance with and/or to accommodate the preferred embodiment(s) presented herein.

Referring now to FIGS. 1 through 6, there are shown various views of a first embodiment of a file folder assembly constructed according to the present invention, the file folder assembly being represented generally by reference numeral 11 (it being understood that, for clarity, certain components of file folder assembly 11 may not be shown in all of FIGS. 1 through 6).

File folder assembly 11 includes a file folder 13. File folder 13, in turn, includes a unitary sheet of material 14, such as, for example, coated or uncoated cardstock, a polypropylene sheet (which sheet can be approximately 10-20 mils in thickness), or a similarly suitable material. Sheet 14 can be cut and scored to define a front panel 15, a rear panel 17, and a top flap 19. Front panel 15 and rear panel 17 can be hingedly interconnected along a fold line 21. It is to be understood that, although front panel 15 is shown in the present embodiment as having a top edge 15-1 that is positioned lower than the corresponding top edge 17-1 of rear panel 17, front panel 15 and rear panel 17 need not be positioned relative to one another as shown, and, if desired, top edge 15-1 can be positioned at the same height as or higher than top edge 17-1. In addition, it is to be understood that, although top edge 15-1 is shown in the present embodiment as having an undulating shape, top edge 15-1 need not be so shaped and, if desired, can be level or otherwise straight. Top flap 19, which can be shaped to include a bottom edge 19-1, a right edge 19-2 and a left edge 19-3, can be folded forwardly towards the front surface 23 of rear panel 17, and adhesive 25 can be used to secure an area 27 along bottom edge 19-1 of flap 19 to front surface 23 of rear panel 17. (In another embodiment, adhesive 25 can also be used to seal right edge 19-2 and left edge 19-3 to corresponding portions of rear panel 17.) A transverse slot 29 can be provided in sheet 14 between rear panel 17 and top flap 19, slot 29 extending just short of the full width of sheet 14 between right end 14-1 and left end 14-2. File folder 13 can have a width $w_1$, as defined by the distance between ends 14-1 and 14-2, that is comparable to the width of a conventional manila folder, e.g., approximately 12 inches.

Figure 7A:
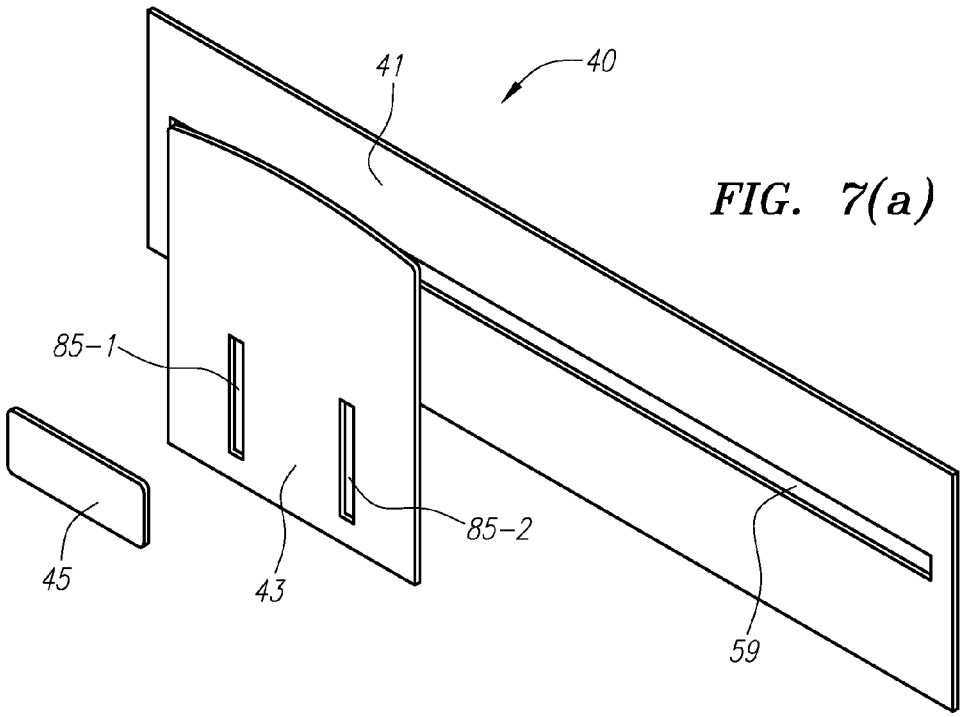
FIGS. 7(*a*) and 7(*b*) are exploded front and rear perspective views, respectively, of the sliding tab assembly of the file folder assembly of FIG. 1.
Figure 7B:
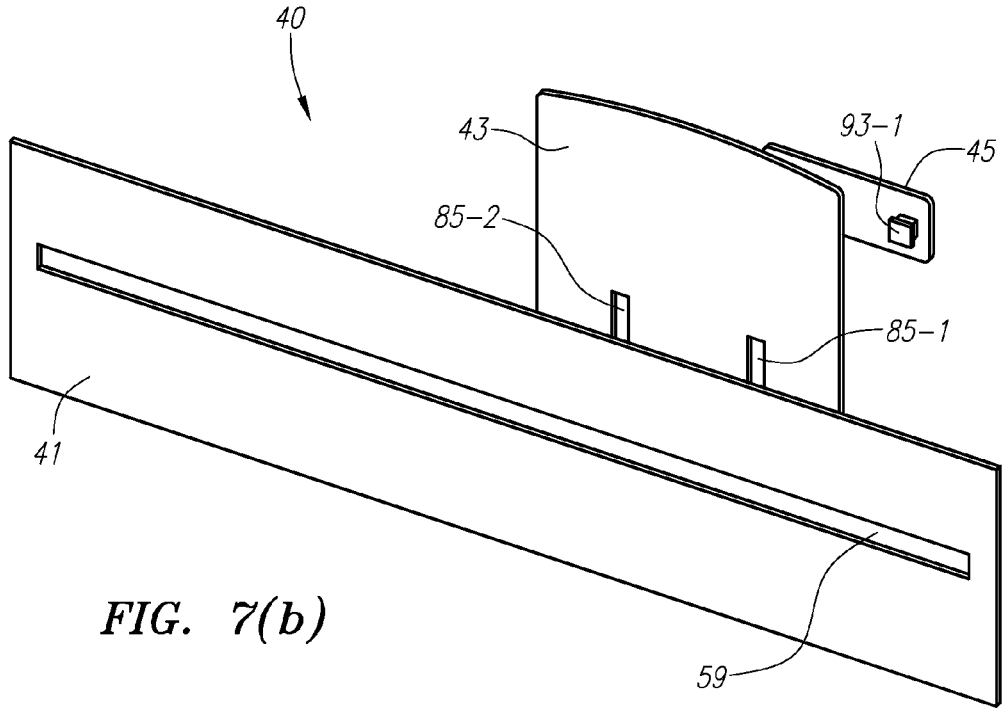
Figure 8A:
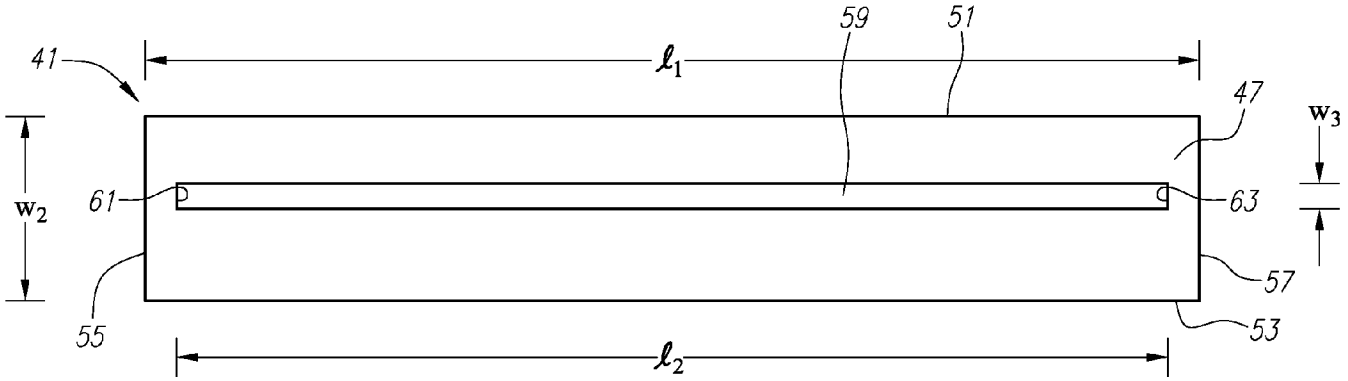
FIGS. 8(*a*) and 8(*b*) are enlarged front and left-side elevational views, respectively, of the rail shown in FIGS. 7(*a*) and 7(*b*)
Figure 8B:
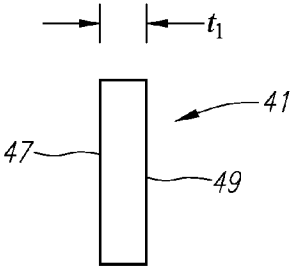

File folder assembly 11 further includes a sliding tab assembly 40, which is also shown separately in FIGS. 7(*a*) and 7(*b*). In the present embodiment, sliding tab assembly 40 includes a slide rail 41, a slidable tab 43, and a pressure plate 45. Slide rail 41, which is also shown separately in FIGS. 8(*a*) and 8(*b*), includes a unitary sheet of material, such as coated or uncoated cardstock, a polypropylene sheet (which sheet can be approximately 10-20 mils in thickness), or a similarly suitable material. Slide rail 41 can be generally rectangular and can be shaped to include a front surface 47, a rear surface 49, a top edge 51, a bottom edge 53, a right edge 55, and a left edge 57. Slide rail 41 can be dimensioned to have a length $l_1$, a width $w_2$, and a thickness $t_1$, wherein length $l_1$ of slide rail 41 is equal to or slightly less than width $w_1$ of sheet 14. Exemplary dimensions for length $l_1$, width $w_2$, and thickness $t_1$ of slide rail 41 can be, for example, approximately 12 inches, approximately 2 inches, and approximately 0.03 inch, respectively. Slide rail 41 is further shaped to include a longitudinally extending transverse slot 59. Slot 59, which can be centered slightly above the longitudinal midline of slide rail 41, can have a length $l_2$ and a width $w_3$. Exemplary dimensions for length $l_2$ and width $w_3$ of slot 59 can be, for example, approximately 11 inches and approximately 0.3 inch, respectively. A right end 61 of slot 59 can be spaced inwardly a short distance from right edge 55 of slide rail 41, and a left end 63 of slot 59 can be spaced inwardly a short distance from left edge 57 of slide rail 41. Slide rail 41 can be affixed to front surface 23 of rear panel 17 using an adhesive 65 or other suitable means (such as welding where, for example, slide rail 41 and file folder 13 are both made of polypropylene), slide rail 41 being positioned just below and parallel to slot 29 and being centered between ends 14-1 and 14-2. Preferably, adhesive 65 is applied to rear surface 49 of slide rail 41 in the area between right end 61 of slot 59 and right edge 55 of slide rail 41 and in the area between left end 63 of slot 59 and left edge 57 of slide rail 41. Additional adhesive 65 can also be applied to rear surface 49 of slide rail 41 in the area between slot 59 and top edge 51 of slide rail 41 and in the area between slot 59 and bottom edge 53 of slide rail 41; however, adhesive 65 is preferably not applied to rear surface 49 of slide rail 41 in the areas directly above and below slot 59 so as to leave some space between slide rail 41 and rear panel 17 within which the rearwardmost portions of pressure plate 45 can slide freely.

Figure 9A:
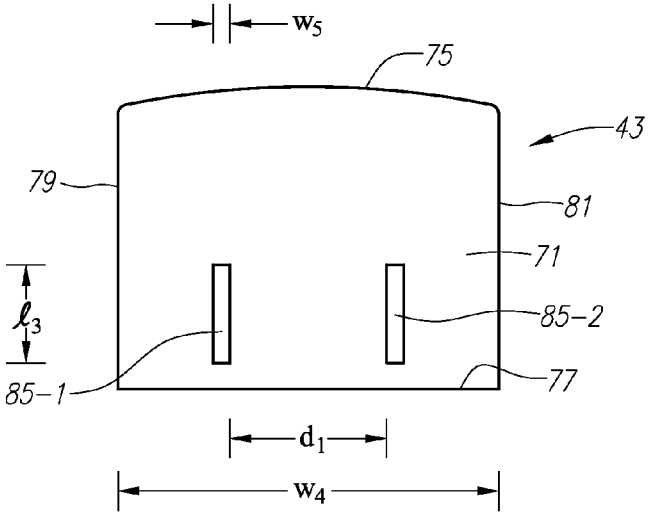
FIGS. 9(*a*) and 9(*b*) are enlarged front and left-side elevational views, respectively, of the tab shown in FIGS. 7(*a*) and 7(*b*)
Figure 9B:
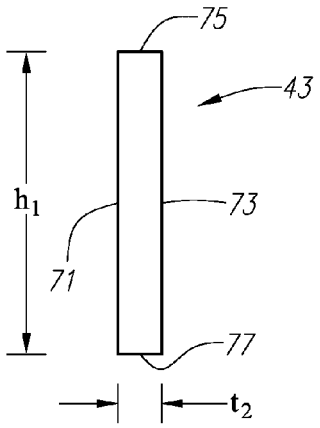

Slidable tab 43, which is also shown separately in FIGS. 9(*a*) and 9(*b*), includes a unitary sheet of material, such as coated or uncoated cardstock, a polypropylene sheet (which sheet can be approximately 10-20 mils in thickness), or a similarly suitable material. Slidable tab 43 can be generally rectangular and can be shaped to include a front surface 71, a rear surface 73, a top edge 75, a bottom edge 77, a right edge 79, and a left edge 81. Slidable tab 43 can be dimensioned to have a height $h_1$, a width $w_4$, and a thickness $t_2$, wherein width $w_4$ of slidable tab 43 is preferably less than width $w_3$ of slot 59. Exemplary dimensions for height $h_1$, width $w_4$, and thickness $t_2$ of slidable tab 43 can be, for example, approximately 3.1 inches, approximately 3.9 inches, and approximately 0.02 inch, respectively. Slidable tab 43 can be further shaped to include a pair of transverse slots 85-1 and 85-2, which can be parallel to one another. Slots 85-1 and 85-2 can be positioned a short distance above bottom edge 77 and can extend vertically in a direction from bottom edge 77 towards top edge 75. Each of slots 85-1 and 85-2 can have a length $l_3$ and a width $w_5$, with the length $l_3$ of each of slots 85-1 and 85-2 being considerably greater than the width $w_3$ of slot 59. In this manner, as will become apparent from the discussion below, tab 43 can be slid generally perpendicularly relative to the longitudinal axis of slot 59. Exemplary dimensions for length $l_3$ and width $w_5$ of slots 85-1 and 85-2 can be, for example, approximately 1 inch and approximately ¼ inch, respectively. Slots 85-1 and 85-2 can be spaced apart by a distance $d_1$, wherein $d_1$ is less than length $l_2$ of slot 59. In this manner, as will become apparent from the discussion below, tab 43 can be slid along the longitudinal axis of slot 59.

Figure 10A:
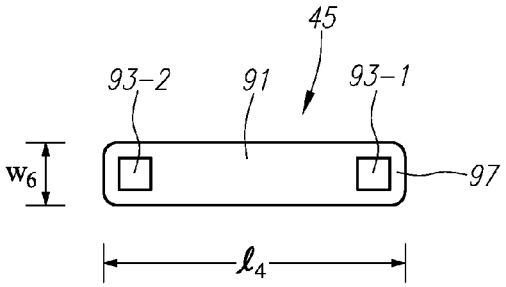
FIGS. 10(*a*) and 10(*b*) are enlarged rear and left-side elevational views, respectively, of the pressure plate shown in FIGS. 7(*a*) and 7(*b*)
Figure 10B:
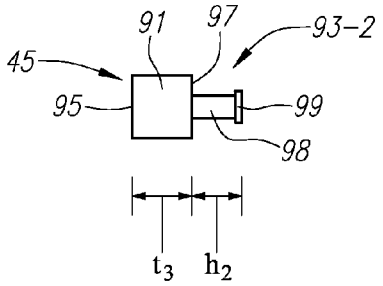

Pressure plate 45, which is also shown separately in FIGS. 10(*a*) and 10(*b*), includes a unitary structure, preferably made of an injection molded plastic, such as an acrylonitrile butadiene styrene, a high-impact polystyrene, or a similarly suitable material. Pressure plate 45 can be shaped to include a generally rectangular base 91 and a pair of posts 93-1 and 93-2, which can be parallel and to one another and which can extend perpendicularly from base 91. More specifically, base 91 can be shaped to include a front surface 95 and a rear surface 97, with posts 93-1 and 93-2 extending rearwardly a short distance from rear surface 97. Base 91 can be dimensioned to have a length $l_4$, a width $w_6$, and a thickness $t_3$. Exemplary dimensions for length $l_4$, width $w_6$, and thickness $t_3$ of base 91 can be, for example, approximately 2.5 inches, approximately ¾ inch, and approximately 0.05 inch, respectively. Posts 93-1 and 93-2 can be dimensioned to have a height $h_2$, which can be, for example, approximately 0.1 inch.

Each of posts 93-1 and 93-2 includes a stem 98 and an enlarged head 99, with each stem 98 being attached at one end to rear surface 97 of base 91 and at an opposite end to enlarged head 99. Posts 93-1 and 93-2 are appropriately dimensioned and arranged on base 91 so that stems 98 extend through slots 85-1 and 85-2 of slidable tab 43 and through slot 59 of slide rail 41. In one embodiment, heads 99, which are positioned between slide rail 41 and rear panel 17, and in one embodiment, are not designed to be withdrawn through slot 59 of slide rail 41 or through slots 85-1 and 85-2 of slidable tab 43. (In another embodiment, heads 99 could be designed to be withdrawn through slot 59 of rail 41 or through slots 85-1 and 95-2 of tab 43.) Thus, pressure plate 45 serves to couple slidable tab 43 to slide rail 41 so as to enable slidable tab 43 to be slid horizontally relative to slide rail 41 (whereby stems 98 are moved horizontally through slot 59) and/or to be slid vertically relative to slide rail 41 (whereby stems 98 are moved vertically through slots 85-1 and 85-2). Moreover, by sizing stems 98 to an appropriate length, not only can one easily slide slidable tab 43 between horizontal and/or vertical positions relative to slide rail 41, but one can also frictionally retain slidable tab 43 in a desired position.

As can be appreciated, because heads 99 of pressure plate 45 are not dimensioned to be inserted through slots 85-1 and 85-2 of slidable tab 43 or through slot 59 of slide rail 41, heads 99 are preferably formed on posts 93-1 and 93-2, for example, by heat-staking, only after stems 98 have been inserted through slidable tab 43 and slide rail 41.

Figure 11:
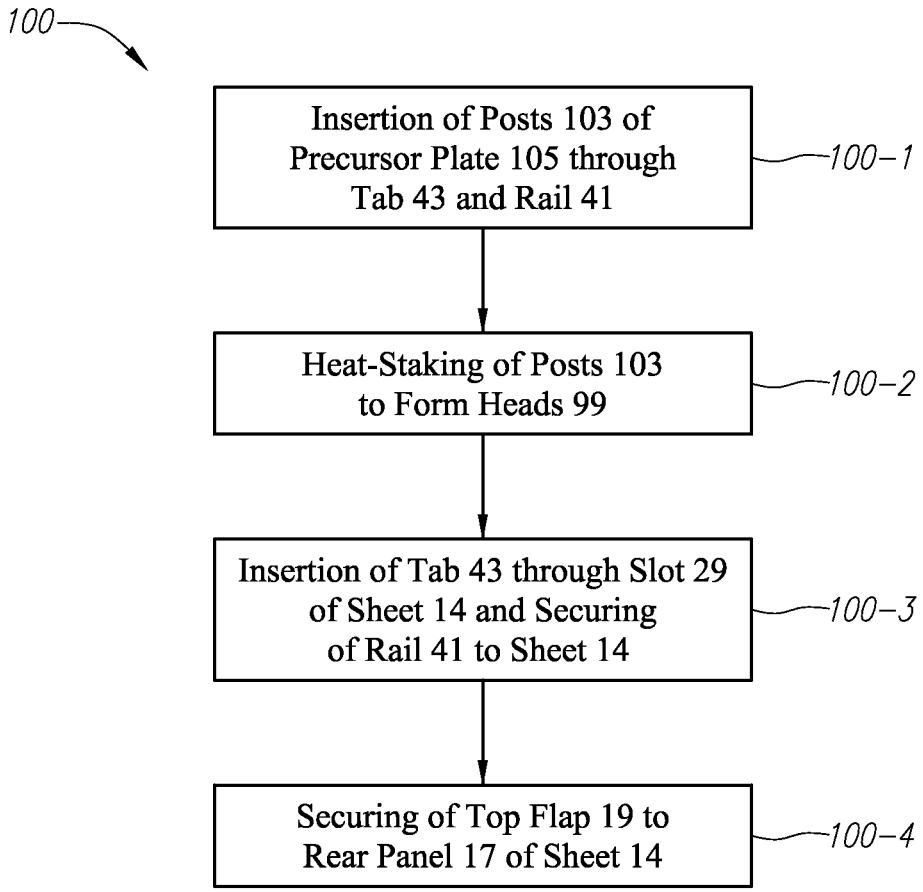
FIG. 11 is a flowchart, schematically illustrating one method of assembling the file folder assembly of FIG. 1.
Figure 12A:
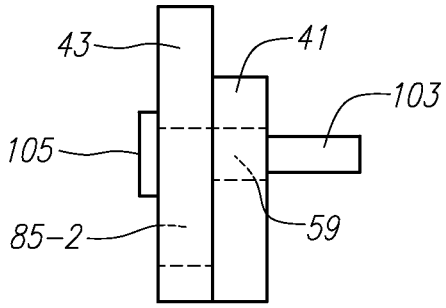
FIGS. 12(*a*) through (*d*) are left-side elevational views, respectively, illustrating certain steps in the method of FIG. 11.
Figure 12B:
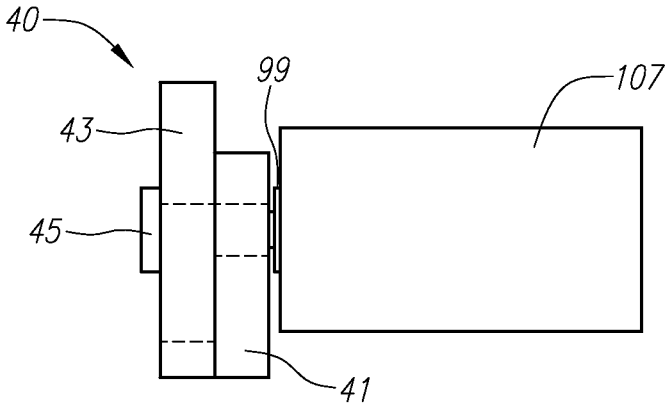
Figure 12C:
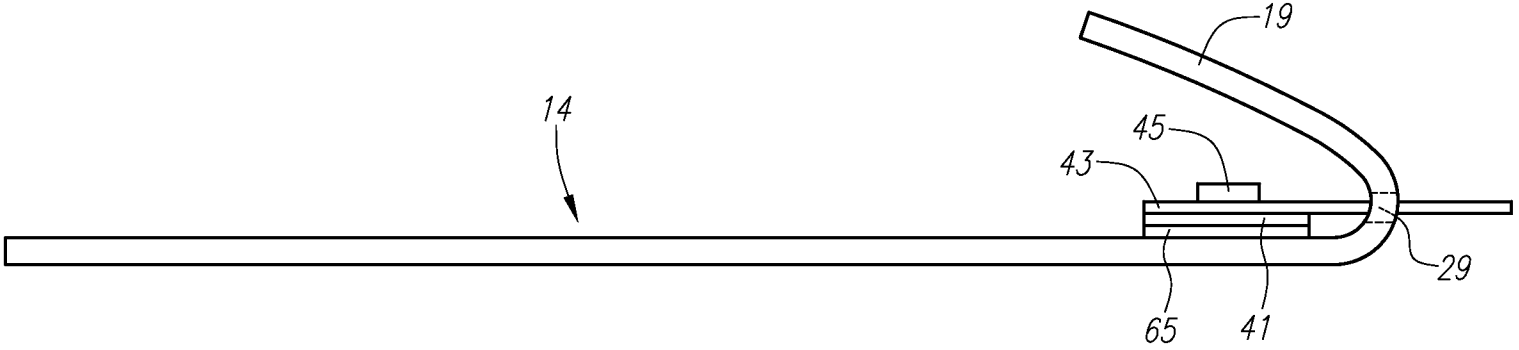
Figure 12D:
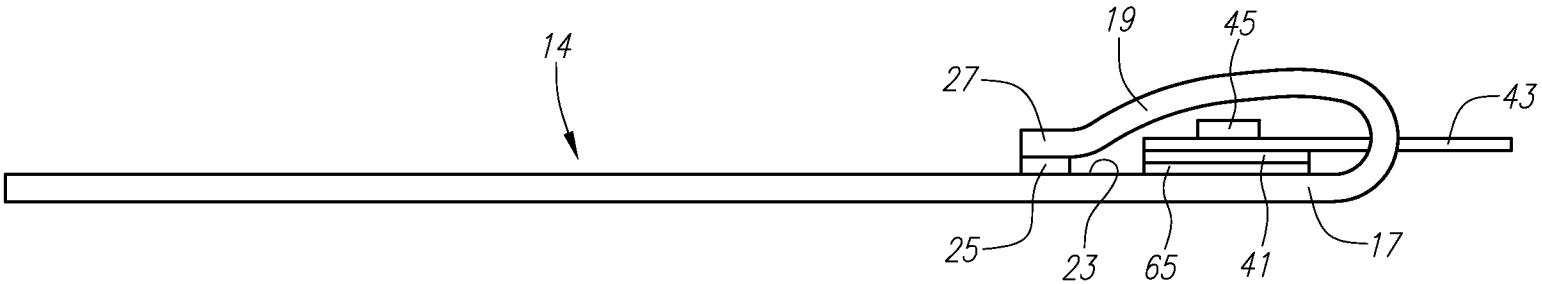

Referring now to FIG. 11, there is shown a flowchart, schematically depicting one method for assembling file folder assembly 11 according to the present invention, said method being represented generally by reference numeral 100. (In addition, some of the steps of method 100 are also depicted in FIGS. 12(*a*) through 12(*d*).) Method 100 can begin in a step 100-1 with the insertion of the headless posts 103 of a precursor pressure plate 105 through slots 85-1 and 85-2 of slidable tab 43 and then through slot 59 of slide rail 41 (see FIG. 12(*a*) with slot 85-2 and slot 59 being shown in phantom). Next, method 100 can continue in a step 100-2 with the heat-staking of posts 103 with a heated press 107 to form heads 99, whereby precursor pressure plate 105 is transformed into pressure plate 45 and whereby sliding tab assembly 40 is assembled (see FIG. 12(*b*)). Next, method 100 can continue in a step 100-3 with the securing of slide rail 41 to sheet 14 and with the insertion of slidable tab 43 through slot 29 of sheet 14 (see FIG. 12(*c*)). Next, method 100 can conclude in a step 100-4 with the securing of top flap 19 to rear panel 17 of sheet 14 (see FIG. 12(*d*)).

In use, papers can be inserted and removed from file folder 13 in the conventional fashion. Identifying indicia can be marked on slidable tab 43 as desired using suitable marking means. To adjust the horizontal and/or vertical positioning of slidable tab 43, one can simply grasp slidable tab 43 and slide slidable tab 43 to a desired horizontal and/or vertical position (slidable tab 43 being horizontally positionable anywhere within slot 29 and being vertically positionable anywhere between a lowermost position extending a comparatively small distance above the top edge of file folder 13 and an uppermost position extending a comparatively great distance above the top edge of file folder 13 (see FIG. 2 where exemplary alternate horizontal and vertical positions for tab 43 are shown)). As can be appreciated, because slidable tab 43 can be moved horizontally and vertically and because such horizontal and vertical movements are independent of one another, slidable tab 43 can be placed in a wider range of positions than is possible with conventional file folder assemblies. Consequently, file folder assembly 11 results in a tab having enhanced visibility.

Figure 13:
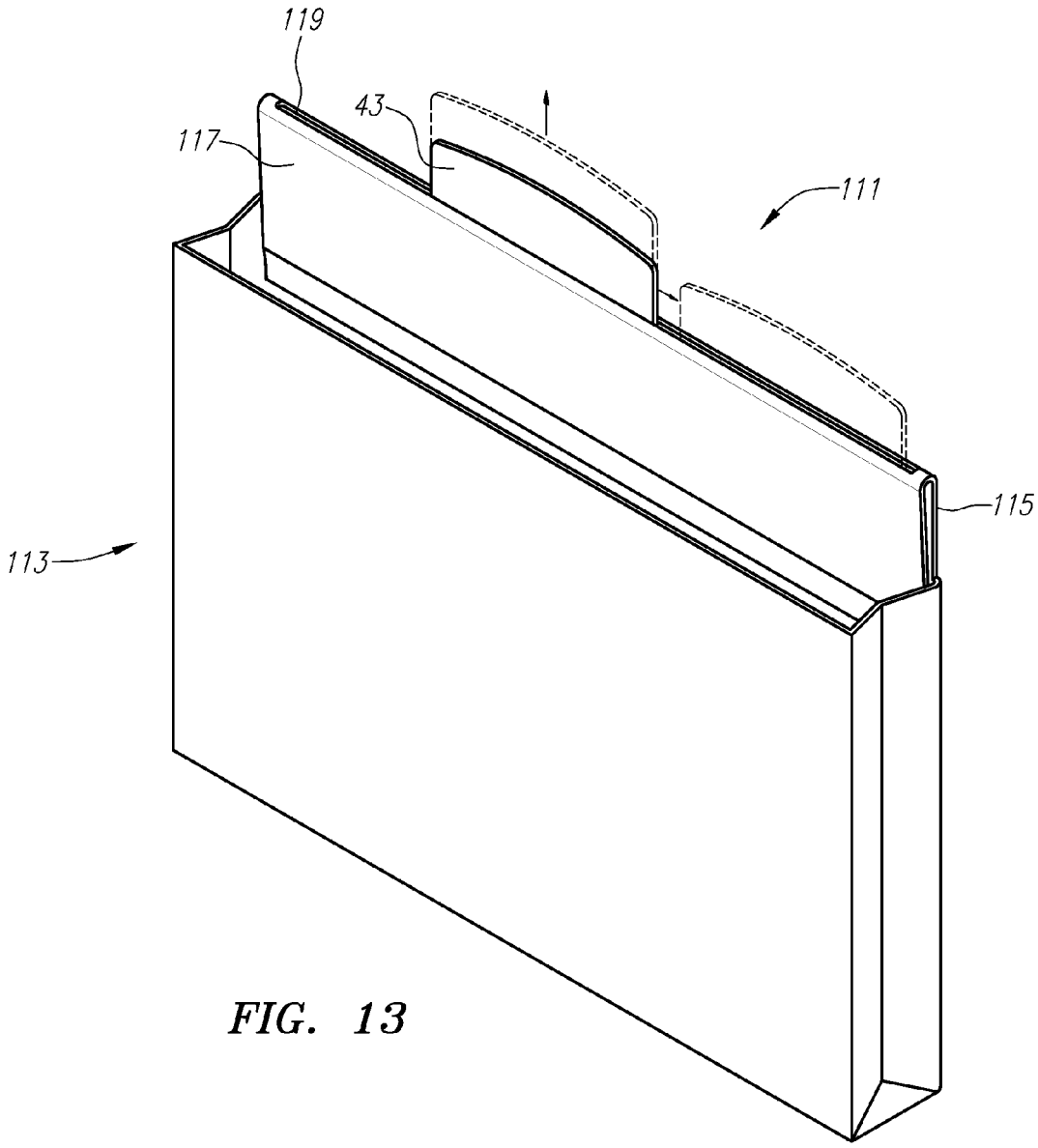
FIG. 13 is a front perspective view of a second embodiment of a file folder assembly constructed according to the present invention, the file folder assembly being shown with a slidable tab in a first position and with exemplary alternative tab positions shown in phantom.

Referring now to FIG. 13, there is shown a front perspective view of a second embodiment of a file folder assembly constructed according to the present invention, the file folder assembly being represented generally by reference numeral 111. File folder assembly 111 is similar in most respects to file folder assembly 11, the principal difference between the two file folder assemblies being that, whereas file folder assembly 11 includes a file folder 13, file folder assembly 111 includes a pocket folder 113. Pocket folder 113 is similar in many respects to conventional pocket folders, the principal differences between pocket folder 113 and conventional pocket folders being that pocket folder 113 includes a rear wall 115 having a folded-over and secured flap 117 and being that pocket folder 113 has a slot 119 through which slidable tab 43 extends. Slidable tab 43 of file folder assembly 111 can be used in a corresponding manner to that discussed above in connection with file folder assembly 11. In exemplary embodiments, the pocket folder 113 can be a single pocket folder or a multi-compartmented folder.

Figure 14:
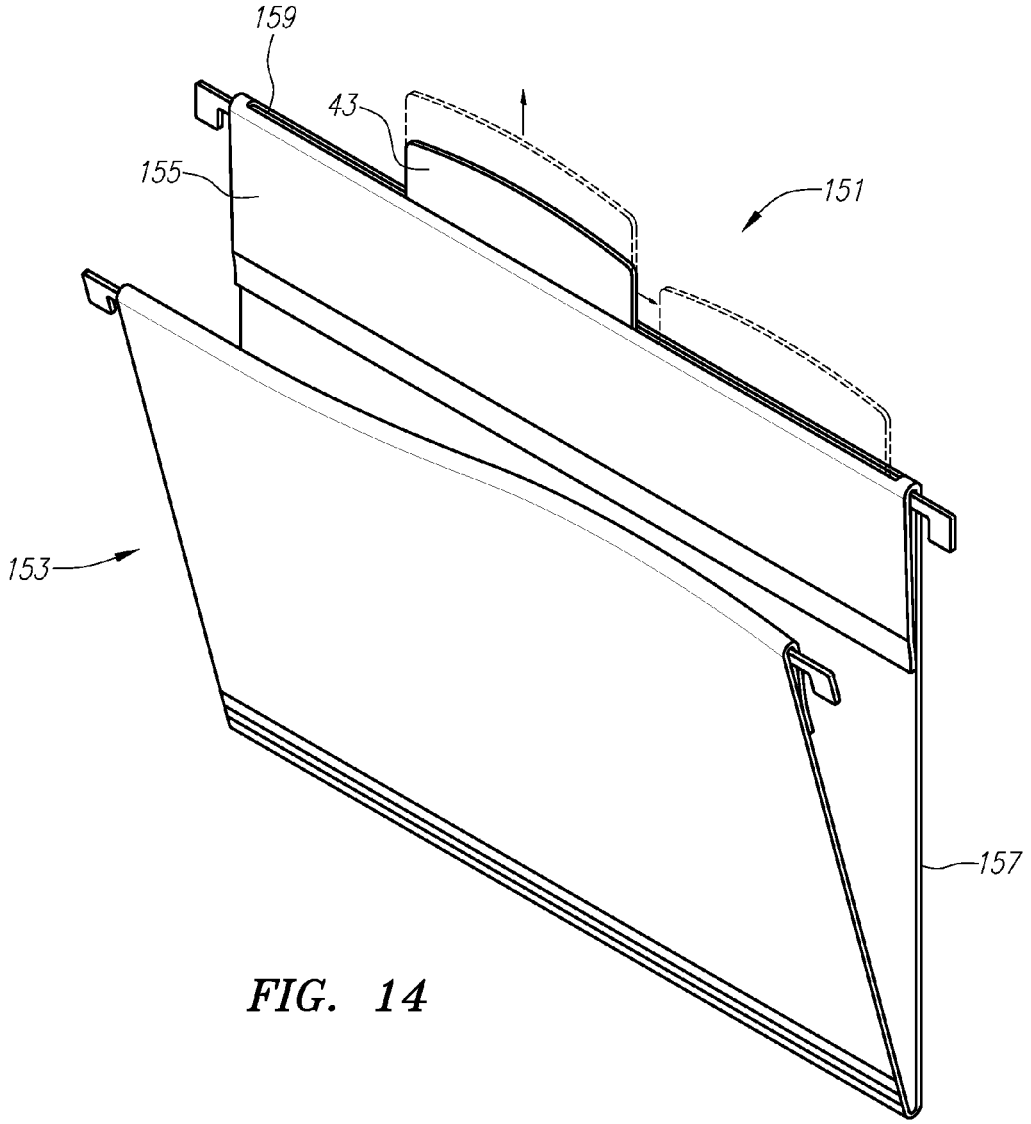
FIG. 14 is a front perspective view of a third embodiment of a file folder assembly constructed according to the present invention, the file folder assembly being shown with the file folder in a slightly opened state and with a slidable tab positioned in a first position, exemplary alternative tab positions being shown in phantom.
Figure 15A:
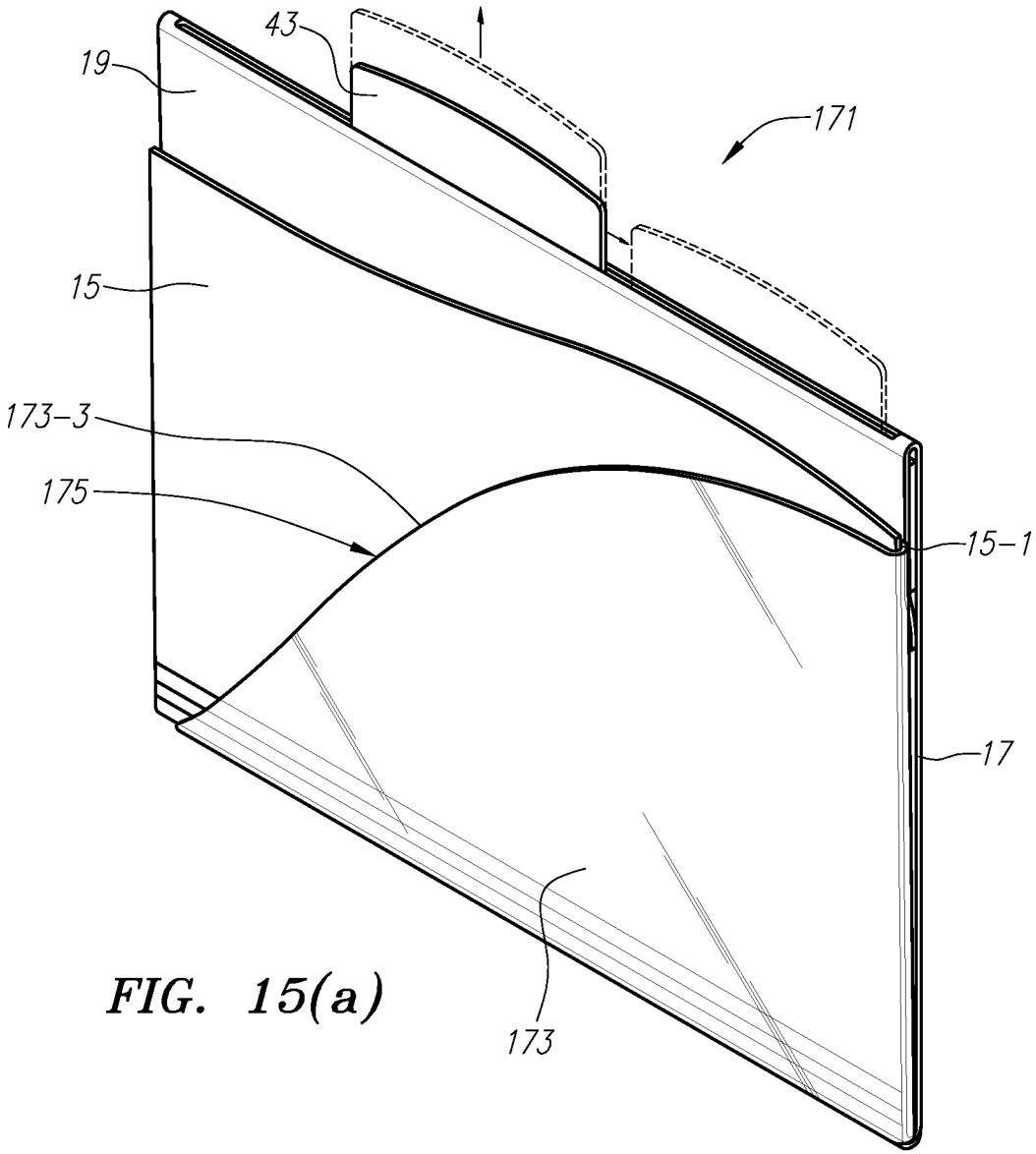
FIGS. 15(*a*) through 15(*g*) are front perspective, front elevational, right-side elevational, left-side elevational, rear elevational, top plan, and bottom plan views, respectively, of a fourth embodiment of a file folder assembly constructed according to the present invention, the file folder assembly being shown with a slidable tab positioned in a first position, exemplary alternate tab positions being shown in phantom in FIG. 15(*a*)
Figures 15B, 15C, 15D:
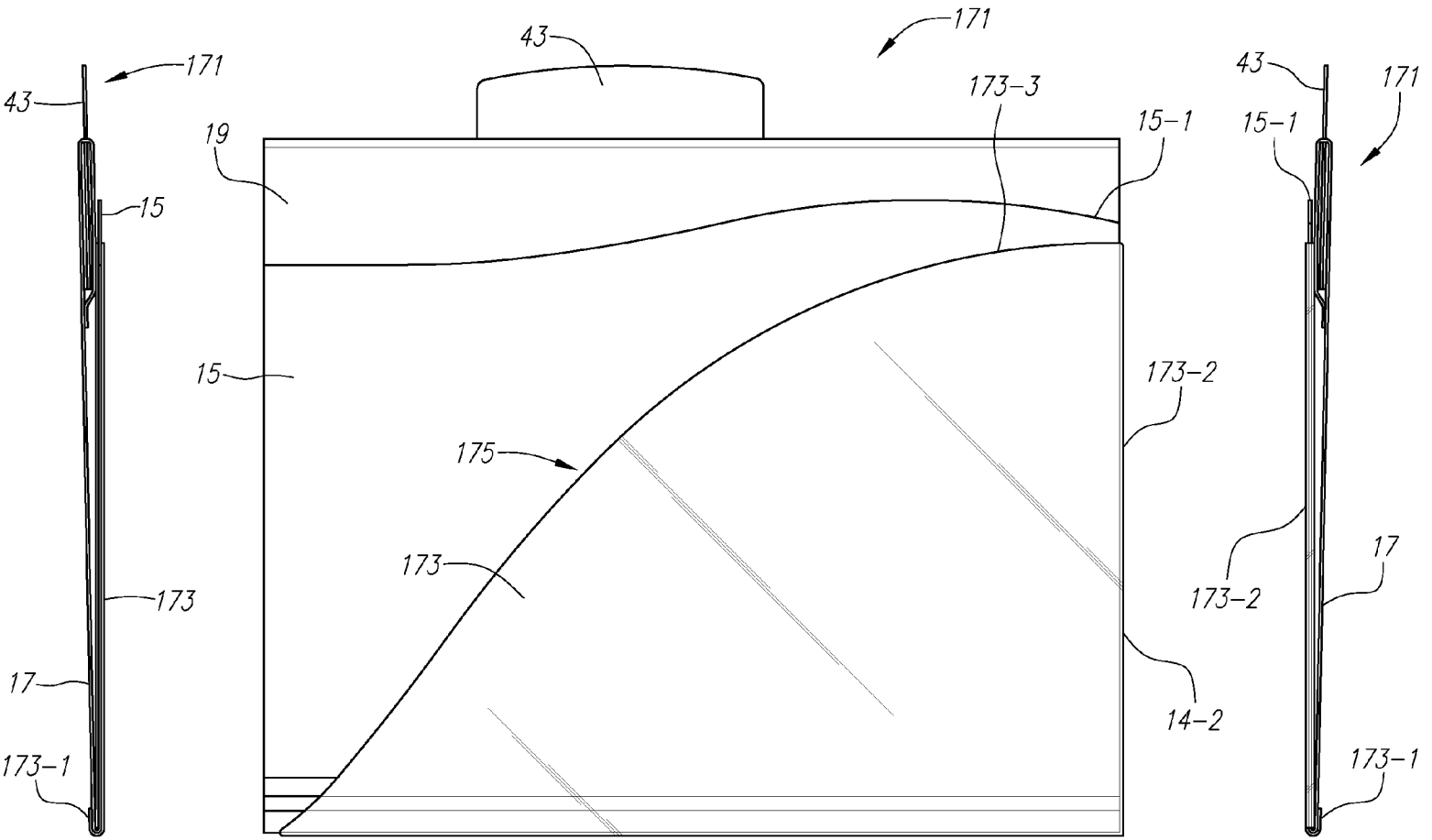
Figure 15E:
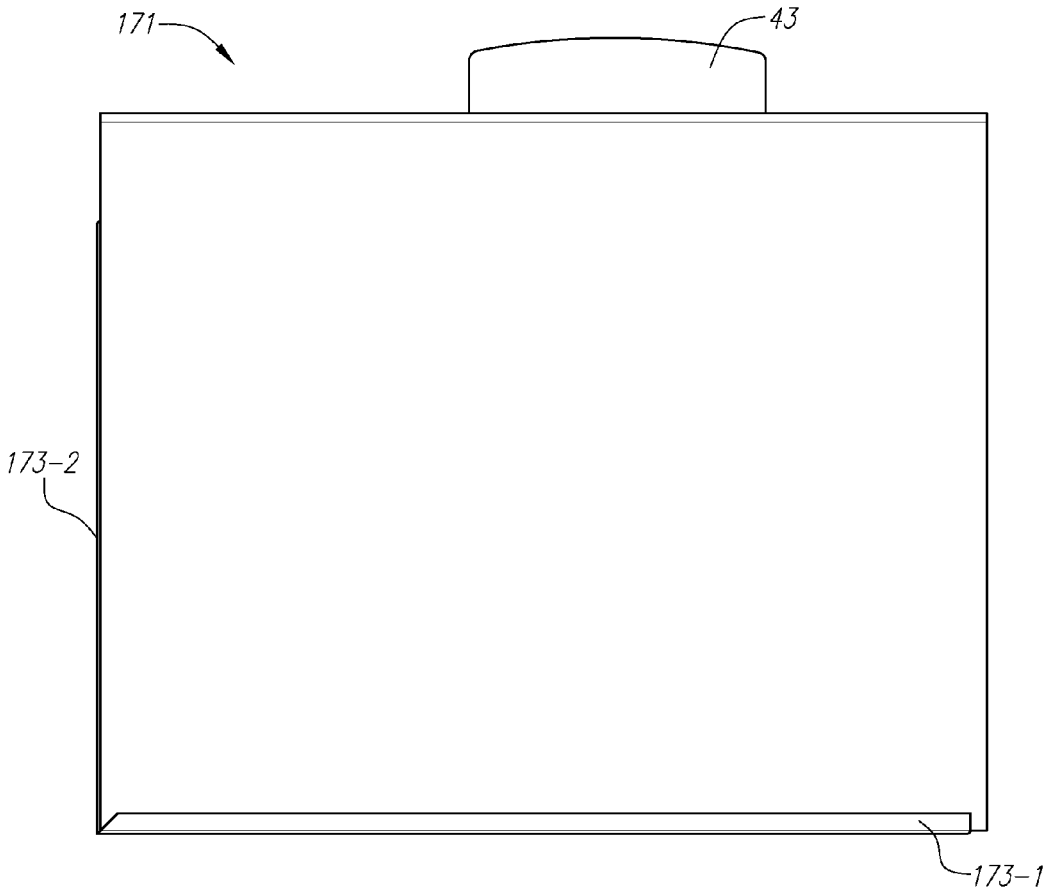
Figure 15F:
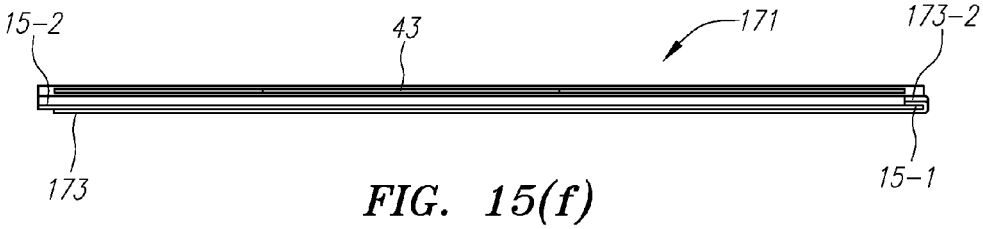
Figure 15G:
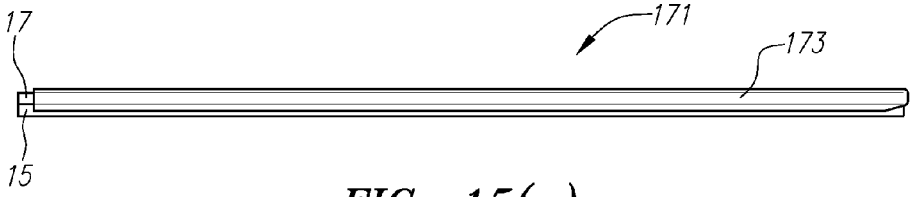
Figure 16:
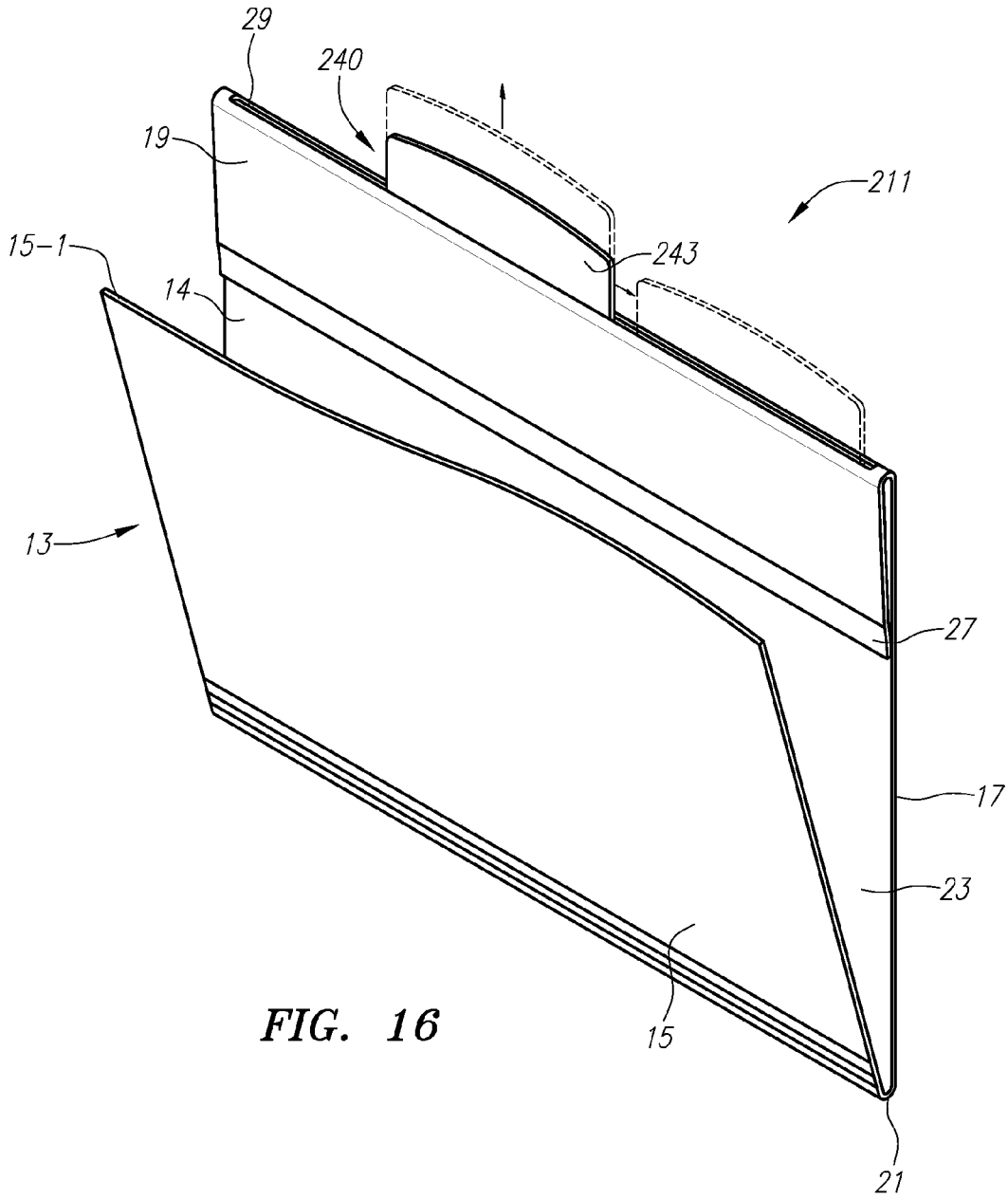
FIG. 16 is a front perspective view of a fifth embodiment of a file folder assembly constructed according to the present invention, the file folder assembly being shown with the file folder in a slightly opened state and with a slidable tab positioned in a first position, exemplary alternative tab positions being shown in phantom.

Referring now to FIG. 14, there is shown a front perspective view of a third embodiment of a file folder assembly constructed according to the present invention, the file folder assembly being represented generally by reference numeral 151. File folder assembly 151 is similar in most respects to file folder assembly 11, the principal difference between the two file folder assemblies being that, whereas file folder assembly 11 includes a file folder 13, file folder assembly 151 includes a hanging file folder 153. Hanging file folder 153 is similar in many respects to conventional hanging file folders, the principal differences between hanging file folder 153 and conventional hanging file folders being that hanging file folder 153 includes a top flap 155 that is folded-over and secured to a rear panel 157 and being that hanging file folder 153 has a slot 159 through which slidable tab 43 extends. Slidable tab 43 of file folder assembly 151 can be used in a corresponding manner to that discussed above in connection with file folder assembly 11.

Referring now to FIGS. 15(*a*) through 15(*g*), there are shown various view of a fourth embodiment of a file folder assembly constructed according to the present invention, the file folder assembly being represented generally by reference numeral 171. File folder assembly 171 is similar in most respects to file folder assembly 11, the principal difference between the two file folder assemblies being that file folder assembly 171 includes a sheet 173. Sheet 173, which can be made of, for example, a clear polymeric material, can be positioned so that a majority of sheet 173 is disposed in front of front panel 15, with a bottom portion 173-1 of sheet 173 wrapping under the bottom of folder 13 and being secured to back panel 17 and with a side portion 173-2 of sheet 173 wrapping around a left end 14-2 of front panel 15 and being secured to a back surface 15-2 of front panel 15. In this manner, sheet 173 forms a pocket 175 with front panel 15, pocket 175 being accessible from its right side and/or top. Pocket 175, therefore, represents a second compartment that can be used to store documents, the first compartment being between front panel 15 and back panel 17. As shown in the present embodiment, sheet 173 can have, but need not have, an arcuate edge 173-3.

File folder assembly 171 can be used in much the same manner as file folder assembly 11, the principal difference in the manner in which file folder assembly 171 can be used being that pocket 175 can also be used to store documents. Tab 43 of file folder assembly 171 can be used in a corresponding manner to that discussed above in connection with file folder assembly 11.

Referring now to FIGS. 16 through 19, there are shown various views of a fifth embodiment of a file folder assembly constructed according to the present invention, the file folder assembly being represented generally by reference numeral 211. File folder assembly 211 is similar in many respects to file folder assembly 11. For example, assembly 211 includes a file folder 13 including a sheet 14 cut and scored to define a front panel 15, a rear panel 17, and a flap 19. The principal difference between file folder assemblies 11 and 211 is that, whereas file folder assembly 11 includes a sliding tab assembly 40, file folder assembly 211 instead includes a sliding tab assembly 240. In the present embodiment, sliding tab assembly 240 includes a slide rail 241, a slidable tab 243, and a sliding coupling plate 245.

Figure 20A:
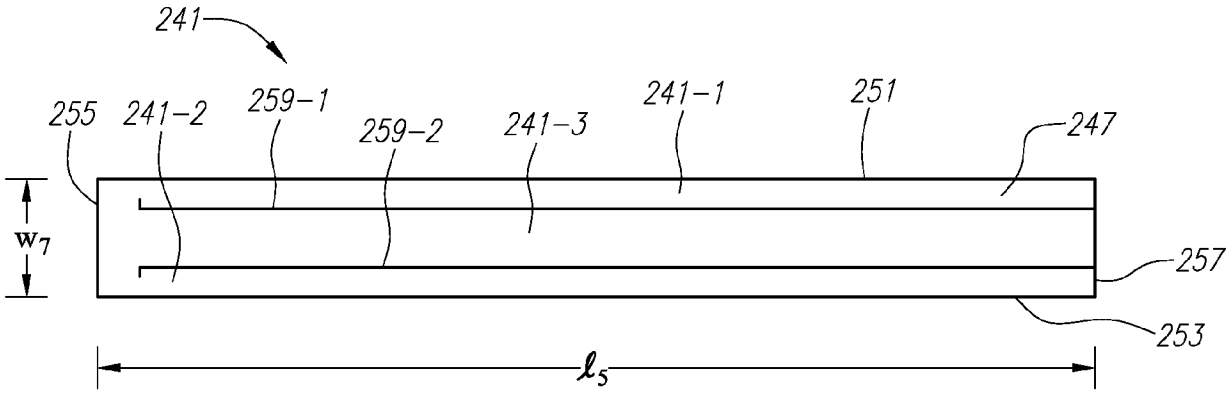
FIGS. 20(*a*) and 20(*b*) are front and left-side elevational views, respectively, of the rail shown in FIG. 17.
Figure 20B:
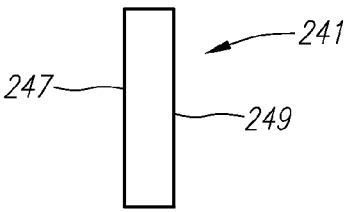

Slide rail 241, which is also shown separately in FIGS. 20(*a*) and 20(*b*), includes a unitary sheet of material, such as a polypropylene sheet (approximately 10-20 mils in thickness) or a similarly suitable material. Slide rail 241 can be generally rectangular and can be shaped to include a front surface 247, a rear surface 249, a top edge 251, a bottom edge 253, a right edge 255, and a left edge 257. Slide rail 241 can be dimensioned to have a length $l_5$ and a width $w_7$, wherein length $l_5$ of slide rail 241 is equal to or slightly less than width $w_1$ of sheet 14. Exemplary dimensions for length $l_5$ and width $w_7$ of slide rail 241 can be, for example, approximately 12 inches and approximately 1.5 inches, respectively. Slide rail 241 further includes a pair of through-cuts 259-1 and 259-2, through-cuts 259-1 and 259-2 being mirror-image L-shaped cuts equidistantly spaced from the longitudinal midline of slide rail 241. Each of cuts 259-1 and 259-2 extends longitudinally from left edge 257 of slide rail 241 to a short distance (e.g., approximately ½ inch) inwardly from right edge 255, with cut 259-1 turning upwardly a short distance (e.g., approximately ⅛ inch) in the direction of top edge 251 and with cut 259-2 turning downwardly a short distance (e.g., approximately ⅛ inch) in the direction of bottom edge 253. Cuts 259-1 and 259-2 effectively divide slide rail 241 into a top portion 241-1, a bottom portion 241-2, and an intermediate portion 241-3. Top portion 241-1 and bottom portion 241-2 can be adhered to rear panel 17 over substantially their entire respective lengths. By contrast, intermediate portion 241-3 is adhered to rear panel 17 only in the area between right edge 255 of slide rail 241 and cuts 259-1 and 259-2 and in the area proximate to left edge 257 of slide rail 241. As a result, intermediate portion 241-3 forms a strap over which coupling plate 245 can be slidably mounted in the manner to be described below.

Figure 21A:
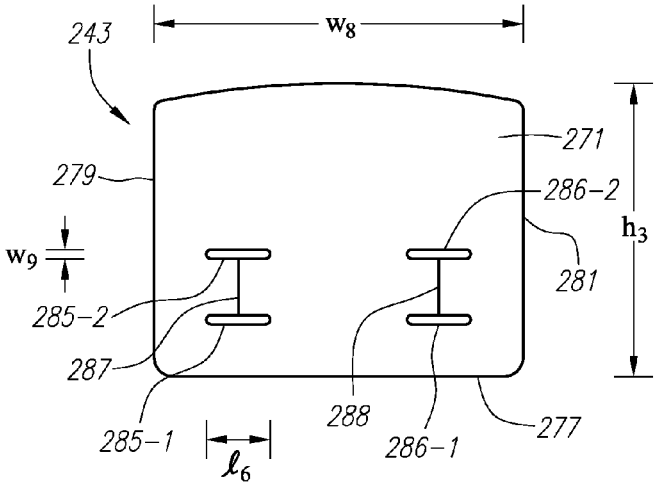
FIGS. 21(*a*) and 21(*b*) are front and left-side elevational views, respectively, of the slidable tab shown in FIG. 17.
Figure 21B:
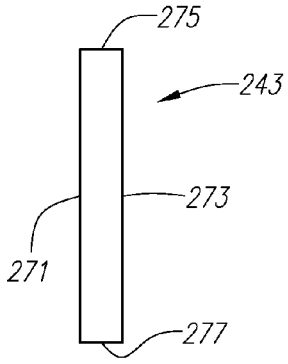

Slidable tab 243, which is also shown separately in FIGS. 21(*a*) and 21(*b*), includes a unitary sheet of material, such as a polypropylene sheet (approximately 10-20 mils in thickness) or a similarly suitable material. Slidable tab 243 can be generally rectangular and can be shaped to include a front surface 271, a rear surface 273, a top edge 275, a bottom edge 277, a right edge 279, and a left edge 281. Slidable tab 243 can be dimensioned to have a height $h_3$ and a width $w_8$. Exemplary dimensions for height $h_3$ and width $w_3$ of slidable tab 243 can be, for example, approximately 3 inches and approximately 4 inches, respectively. Slidable tab 243 can be further shaped to include two pairs of transverse slots 285-1/285-2 and 286-1/286-2. Slots 285-1 and 286-1 can be positioned a short distance (e.g., approximately ½ inch) above bottom edge 277 and can extend horizontally. Slots 285-2 and 286-2 can be parallel to and spaced a short distance (e.g., approximately ½ inch) above slots 285-1 and 286-1, respectively. A through-cut 287 can interconnect slots 285-1 and 285-2, and a corresponding through-cut 288 can interconnect slots 286-1 and 286-2. Each of slots 285-1, 285-2, 286-1 and 286-2 can have a length $l_6$ and a width $w_9$, with exemplary dimensions for length $l_6$ and width $w_9$ being approximately ½ inch and approximately 0.06 inch, respectively.

Figure 17:
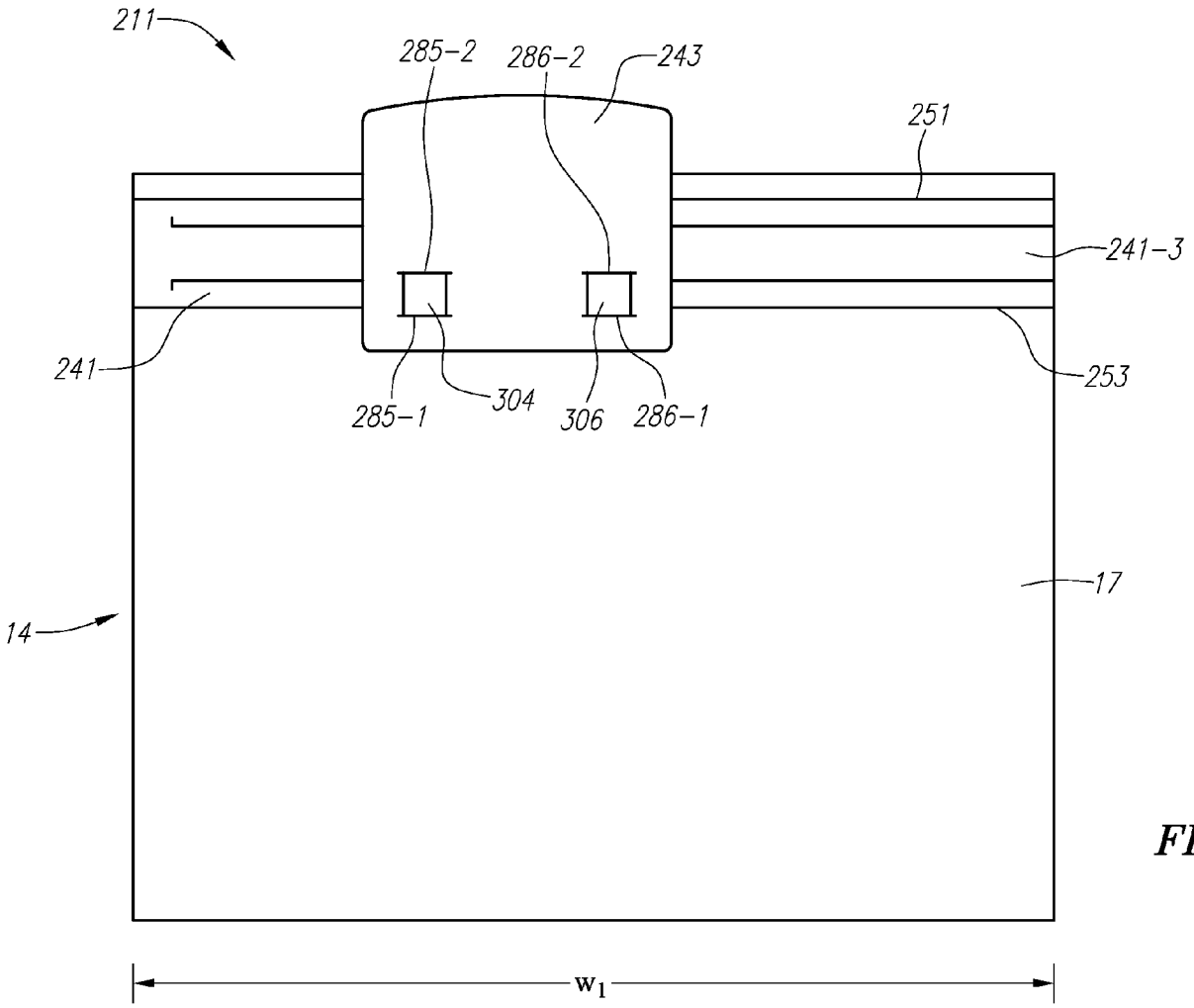
FIG. 17 is a front elevational view of the file folder assembly shown in FIG. 16, with the front panel and the top flap of the file folder not being shown to reveal certain details of the sliding tab assembly, the slidable tab being positioned in its lowermost position.
Figure 22A:
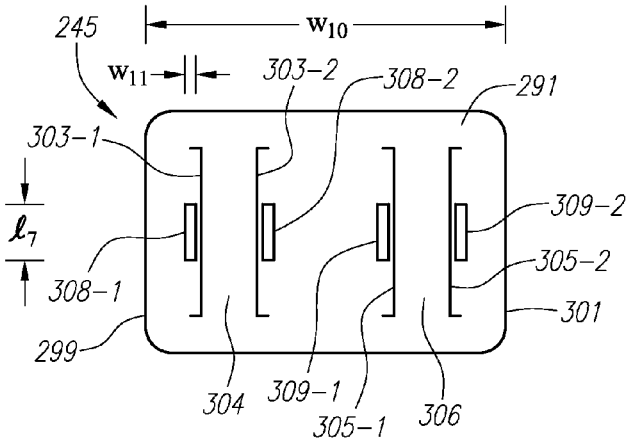
FIGS. 22(*a*) and 22(*b*) are front and side elevational views, respectively, of the coupling plate shown in FIG. 17.
Figure 22B:
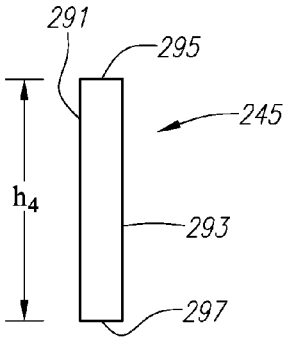

Sliding coupling plate 245, which is also shown separately in FIGS. 22(*a*) and 22(*b*), includes a unitary sheet of material, such as a polypropylene sheet (approximately 10-20 mils in thickness) or a similarly suitable material. Coupling plate 245 can be generally rectangular and can be shaped to include a front surface 291, a rear surface 293, a top edge 295, a bottom edge 297, a right edge 299, and a left edge 301. Coupling plate 245 can be dimensioned to have a height $h_4$ and a width $w_{10}$. Exemplary dimensions for height $h_4$ and width $w_{10}$ of coupling plate 245 can be, for example, approximately 2 inches and approximately 3.5 inches, respectively. Coupling plate 245 is further shaped to include two pairs of mirror-image C-shaped cut-lines 303-1/303-2 and 305-1/305-2. Each of cut-lines 303-1, 303-2, 305-1 and 305-2 can be positioned a short distance (e.g., approximately ½ inch) above bottom edge 297 and can extend vertically for a distance (e.g., approximately 1.6 inch). Cut-lines 303-1 and 303-2 can be spaced apart from one another by a short distance (e.g., approximately ½ inch) and can effectively define therebetween a strap 304. Similarly, cut lines 305-1 and 305-2 can be spaced apart from one another by a short distance (e.g., approximately ½ inch) and can effectively define therebetween a strap 306. Slidable tab 243 and coupling plate 245 can be coupled to one another by weaving strap 304 of coupling plate 245 into slots 285-1 and 285-2 of slidable tab 243 and by weaving strap 306 of coupling plate 245 into slots 286-1 and 286-2 of slidable tab 243, as shown in FIG. 17. (Such weaving can be effected by pushing straps 304 and 306 through slots 287 and 288, respectively.) In this manner, slidable tab 243 is mounted on coupling plate 245 for sliding vertical movement.

Figure 18:
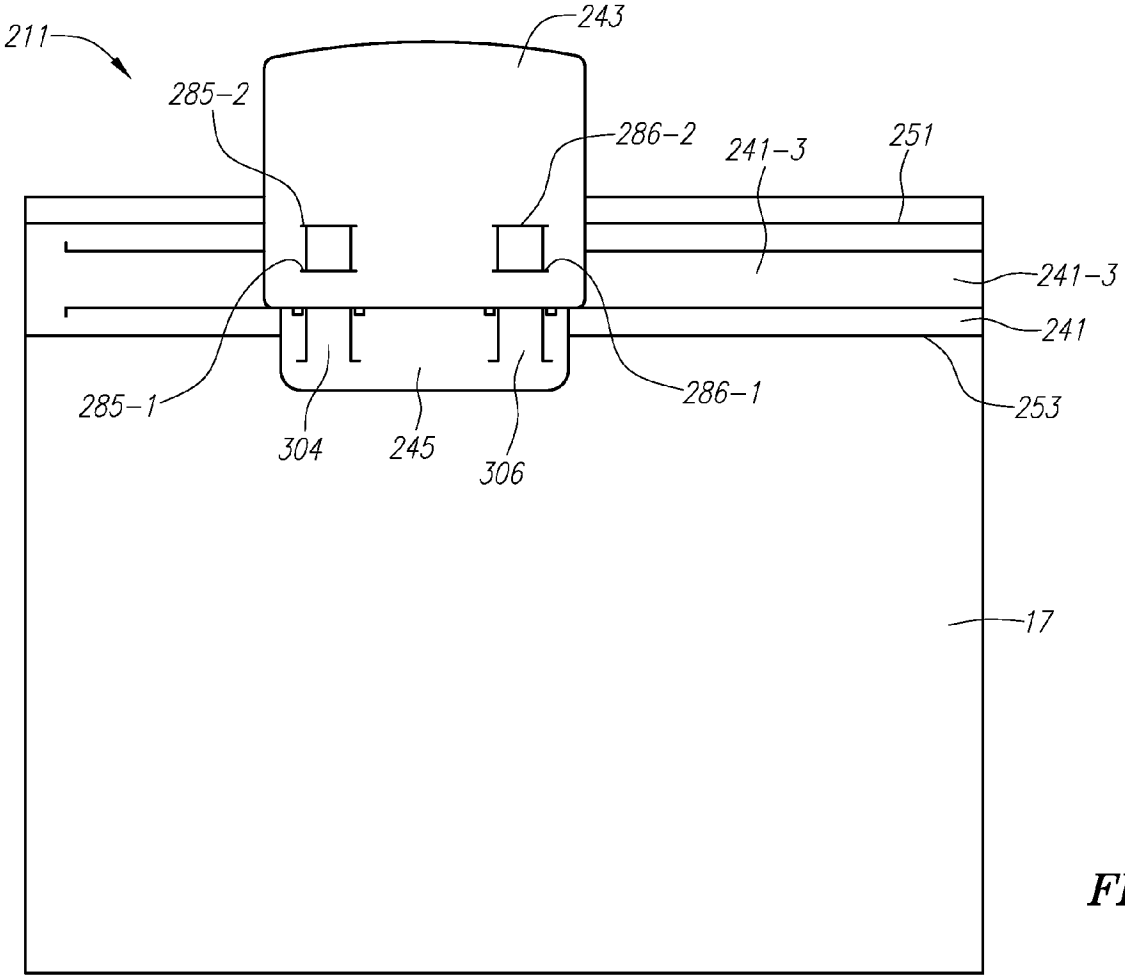
FIG. 18 is a front elevational view of the file folder assembly shown in FIG. 16, with the front panel and the top flap of the file folder not being shown to reveal certain details of the sliding tab assembly, the slidable tab being positioned in its uppermost position.
Figure 19:
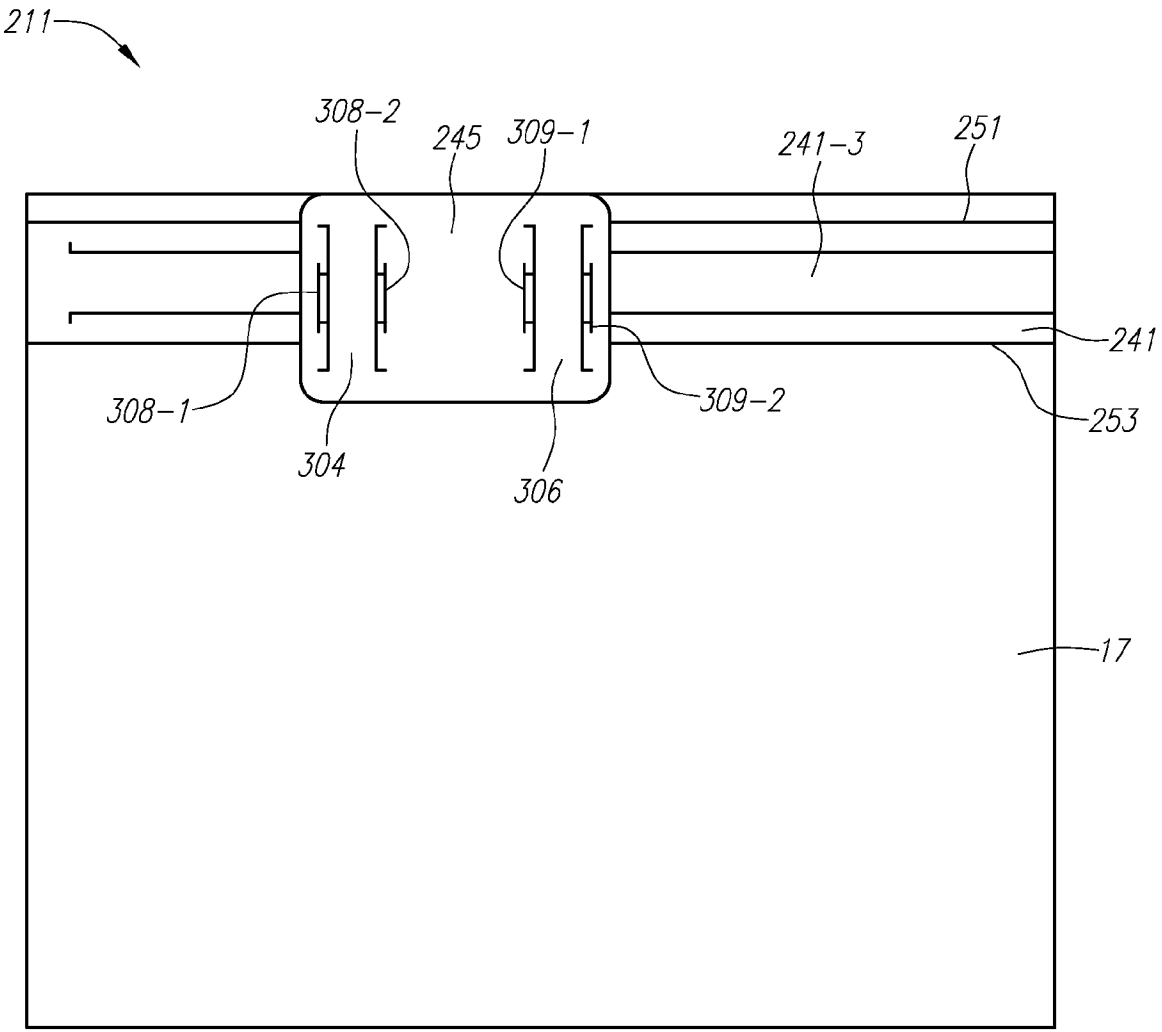
FIG. 19 is a front elevational view of the file folder assembly shown in FIG. 16, with the front panel and the top flap of the file folder not being shown and with the sliding tab not being shown to reveal the manner of connection of the sliding plate to the sliding rail.

Coupling plate 245 is further shaped to include two pairs of transverse slots 308-1/308-2 and 309-1/309-2, which can be parallel to one another. Slots 308-1 and 308-2 can be positioned on opposite sides of strap 304 and can extend vertically. Slots 309-1 and 309-2 can be positioned on opposite sides of strap 306 and can extend vertically. Each of slots 308-1, 308-2, 309-1 and 309-2 can be vertically aligned with the others, and each of slots 308-1, 308-2, 309-1 and 309-2 can have a length $l_7$ and a width $w_{11}$, with exemplary dimensions for length $l_7$ and width $w_{11}$ being approximately ½ inch and approximately 0.06 inch, respectively. Coupling plate 245 and slide rail 241 can be coupled to one another by weaving intermediate portion 241-3 of slide rail 241 through slots 308-1, 308-2, 309-1 and 309-2, as shown in FIG. 18. In this manner, coupling plate 245 is mounted on slide rail 241 for sliding horizontal movement.

To assemble file folder assembly 211, one can weave together coupling plate 245 and slidable tab 243 in the manner discussed above and can weave together coupling plate 245 and slide rail 241 in the manner discussed above. Then, one can adhere rear surface 249 of slide rail 241 to rear panel 17 in the manner discussed above. Then, one can insert slidable tab 243 through slot 29 of flap 19 and can secure flap 19 to front surface 23 of rear panel 17. File folder assembly 211 can be used in a fashion analogous to that discussed above in connection with file folder assembly 11.

Figure 23:
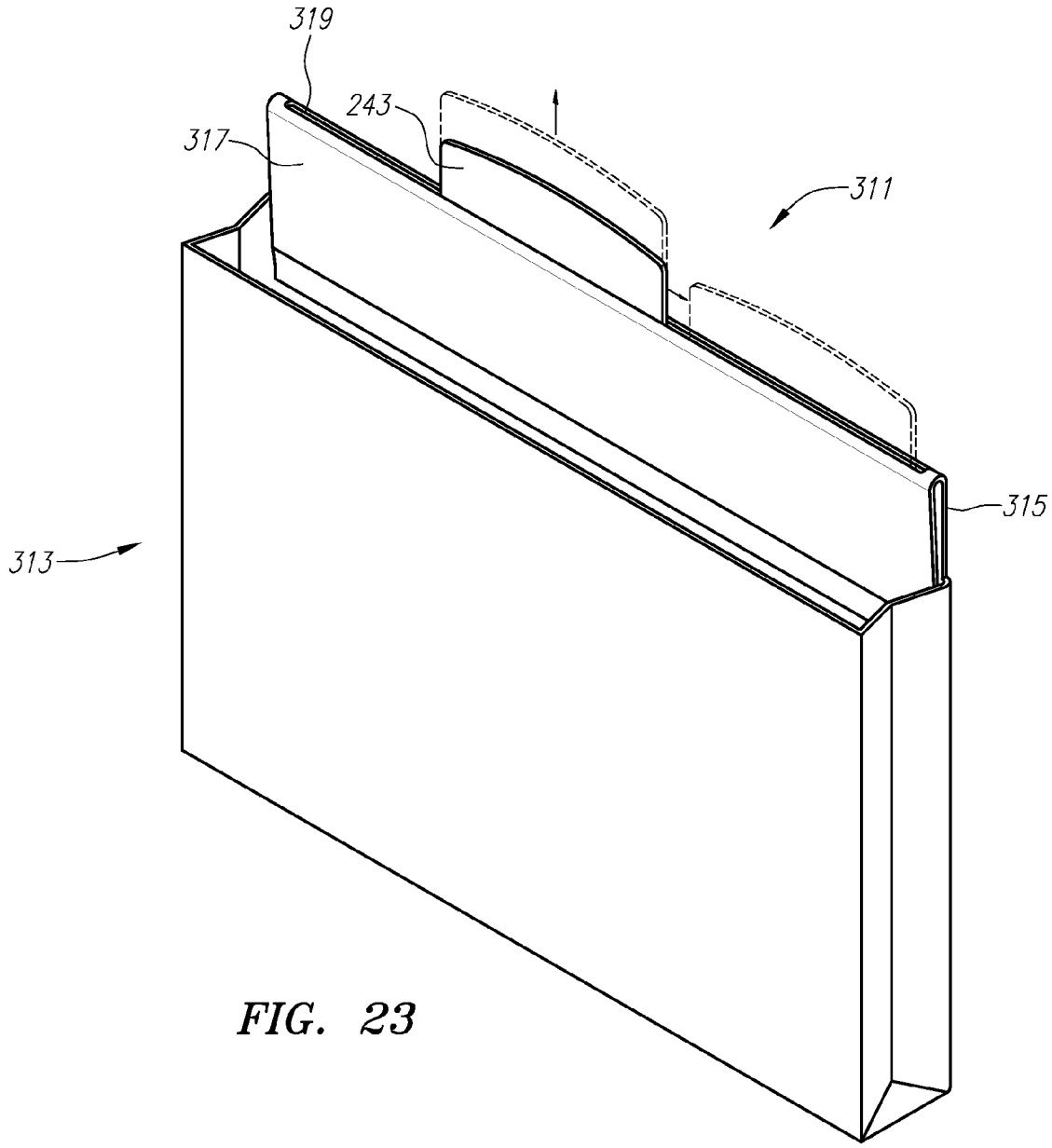
FIG. 23 is a front perspective view of a sixth embodiment of a file folder assembly constructed according to the present invention, the file folder assembly being shown with a slidable tab in a first position and with exemplary alternative tab positions shown in phantom.

Referring now FIG. 23, there is shown a front perspective view of a sixth embodiment of a file folder assembly constructed according to the present invention, the file folder assembly being represented generally by reference numeral 311. File folder assembly 311 is similar in most respects to file folder assembly 211, the principal difference between the two file folder assemblies being that, whereas file folder assembly 211 includes a file folder 13, file folder assembly 311 includes a pocket folder 313. Pocket folder 313 is similar in many respects to conventional pocket folders, the principal differences between pocket folder 313 and conventional pocket folders being that pocket folder 313 includes a rear wall 315 having a folded-over and secured flap 317 and being that pocket folder 313 has a slot 319 through which slidable tab 243 extends. Slidable tab 243 of file folder assembly 311 can be used in a corresponding manner to that discussed above in connection with file folder assembly 11.

Figure 24:
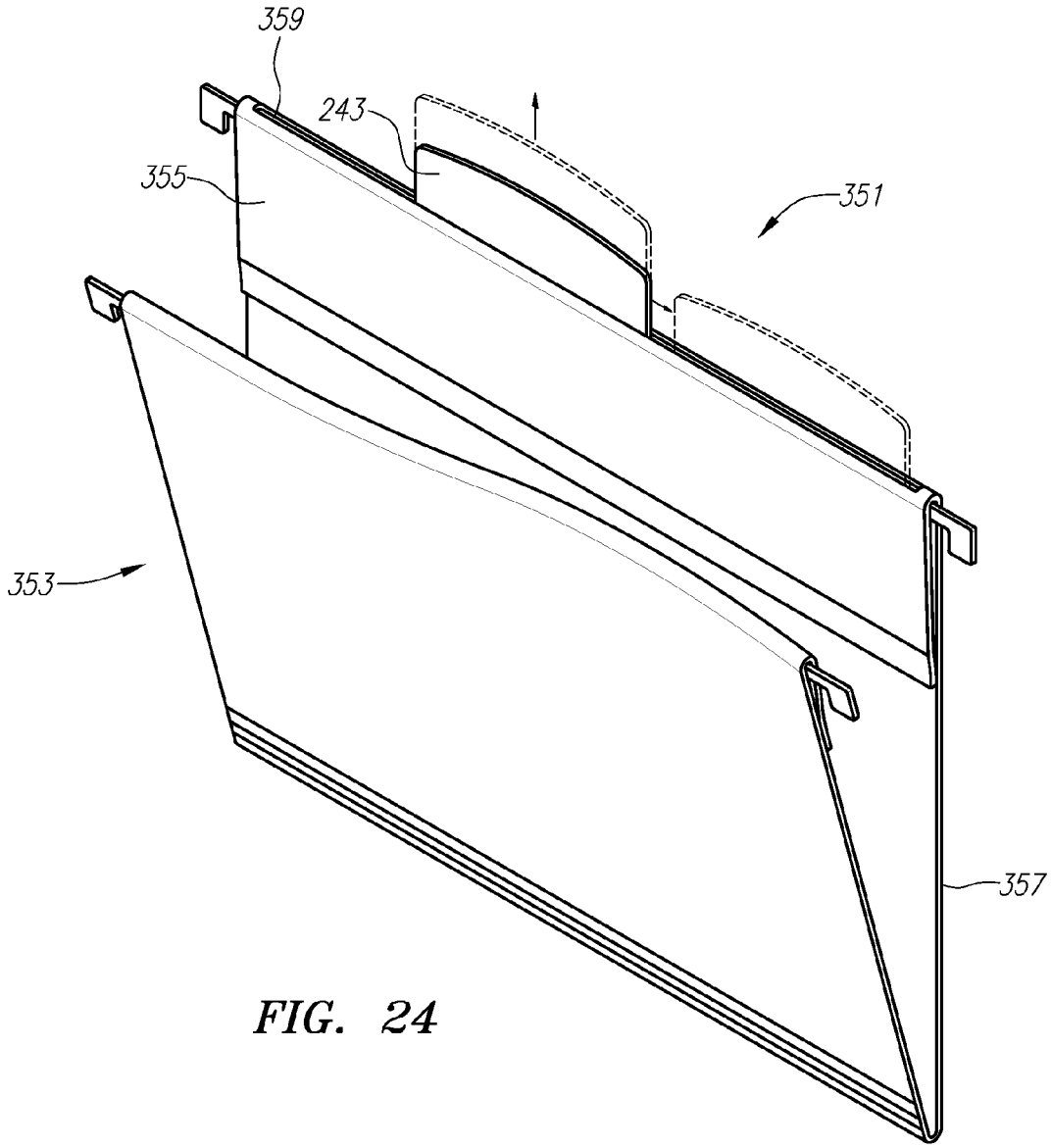
FIG. 24 is a front perspective view of a seventh embodiment of a file folder assembly constructed according to the present invention, the file folder assembly being shown with a slidable tab in a first position and with exemplary alternate tab positions shown in phantom.

Referring now to FIG. 24, there is shown a front perspective view of a seventh embodiment of a file folder assembly constructed according to the present invention, the file folder assembly being represented generally by reference numeral 351. File folder assembly 351 is similar in most respects to file folder assembly 211, the principal difference between the two file folder assemblies being that, whereas file folder assembly 211 includes a file folder 13, file folder assembly 351 includes a hanging file folder 353. Hanging file folder 353 is similar in many respects to conventional hanging file folders, the principal differences between hanging file folder 353 and conventional hanging file folders being that hanging file folder 353 includes a top flap 355 that is folded-over and secured to a rear panel 357 and being that hanging file folder 353 has a slot 359 through which slidable tab 243 extends. Slidable tab 243 of file folder assembly 351 can be used in a corresponding manner to that discussed above in connection with file folder assembly 11.

Figure 25:
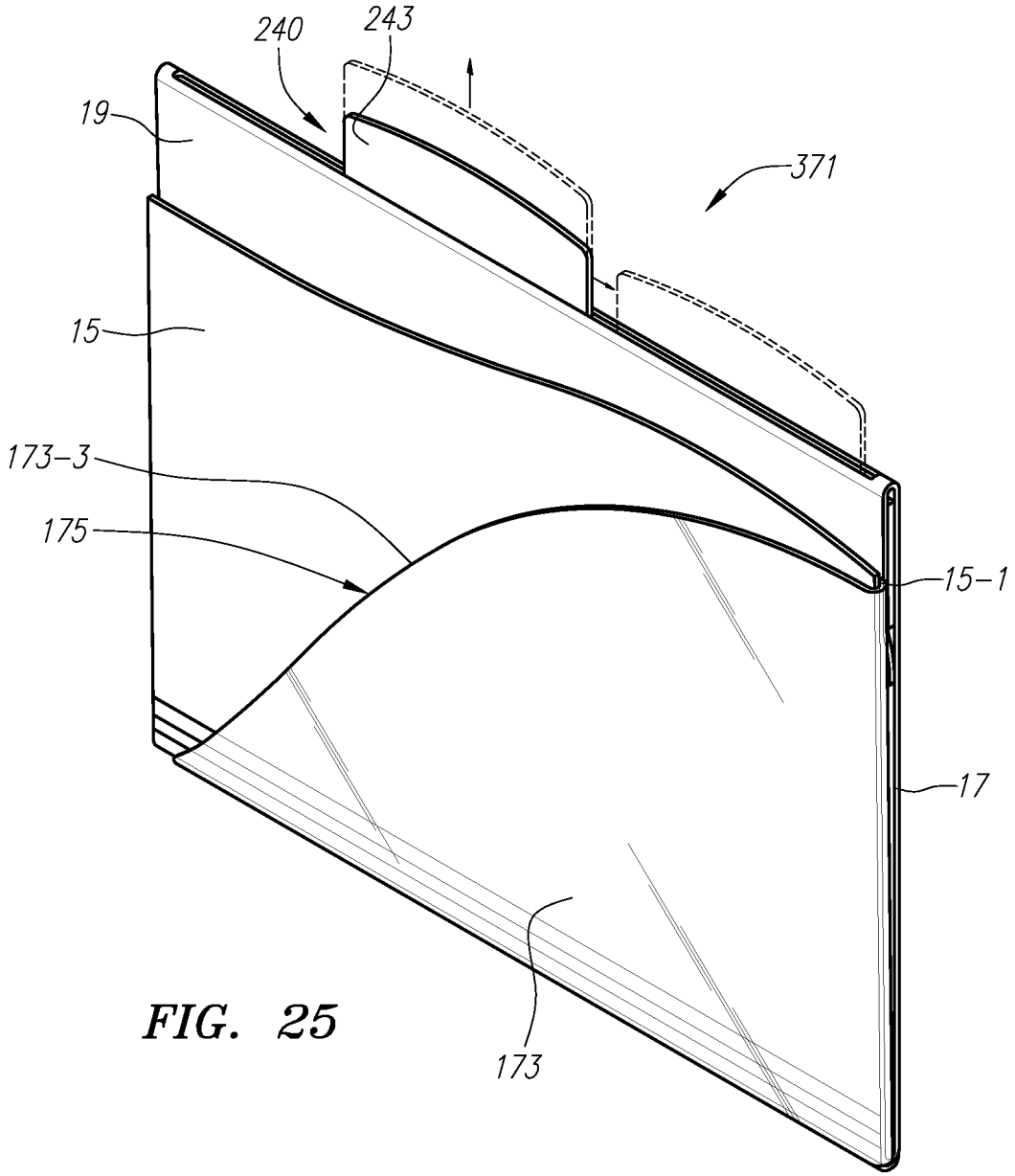
FIG. 25 is a front perspective view of an eighth embodiment of a file folder assembly constructed according to the present invention, the file folder being shown with a slidable tab positioned in a first position, exemplary alternate tab positions being shown in phantom.

Referring now to FIG. 25, there is shown a front perspective view of an eighth embodiment of a file folder assembly constructed according to the present invention, the file folder assembly being represented generally by reference numeral 371. File folder assembly 371 is similar in most respects to file folder assembly 171, the principal difference between the two file folder assemblies being that, whereas file folder assembly 171 includes sliding tab assembly 40, file folder assembly 371 includes sliding tab assembly 240. File folder assembly 371 can be used in a corresponding manner to that discussed above in connection with file folder assembly 11.

Figure 26:
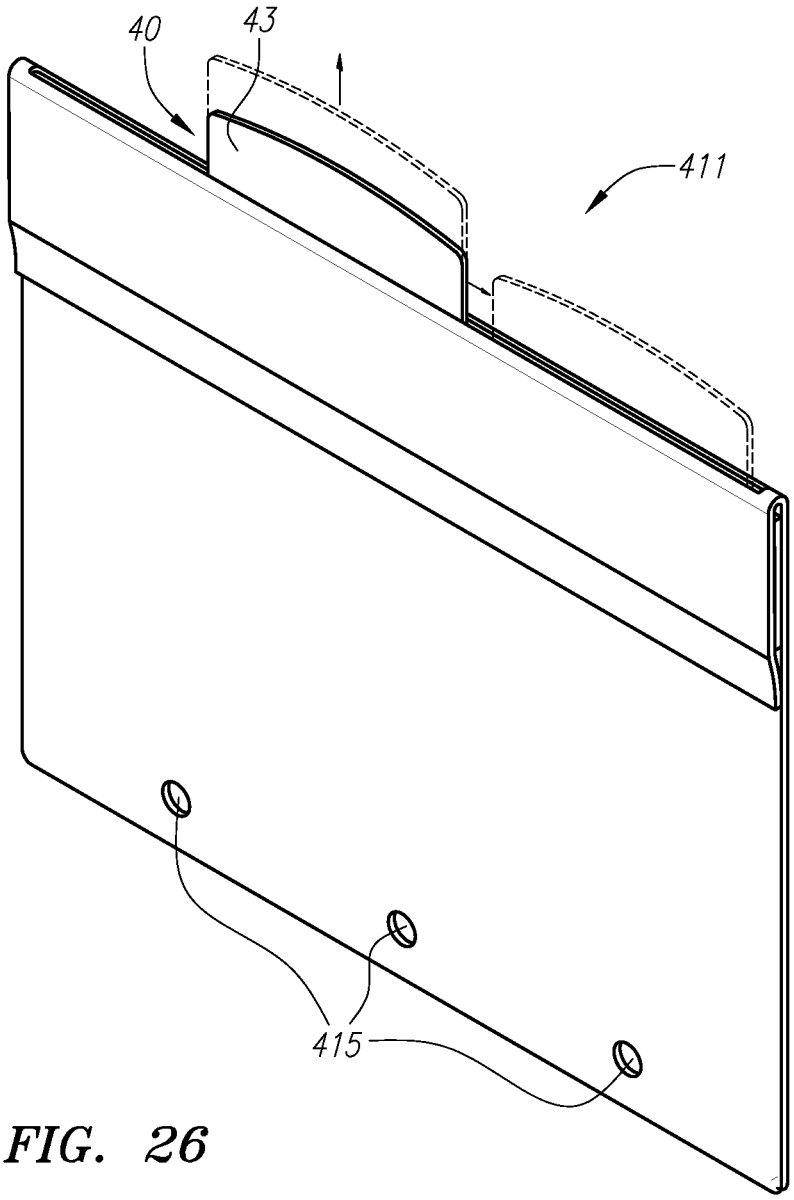
FIG. 26 is a front perspective view of a first embodiment of a divider constructed according to the present invention, the divider being shown with a slidable tab positioned in a first position, exemplary alternate tab positions being shown in phantom.

Referring now to FIG. 26, there is shown a front perspective view of a first embodiment of a divider constructed according to the present invention, the divider being represented generally by reference numeral 411. Divider 411 is similar in many respects to file folder assembly 11, the principal differences between divider 411 and file folder assembly 11 being (1) that divider 411 does not include a structure corresponding to front panel 15 of file folder assembly 11, and (2) that divider 411 can include a plurality of transverse openings 415 in panel 17. Openings 415 can be arranged to permit divider 411 to be mounted in a three-ring binder or similar device. Tab 40 of divider 411 can be used in a corresponding manner to that discussed above in connection with file folder assembly 11.

Figure 27:
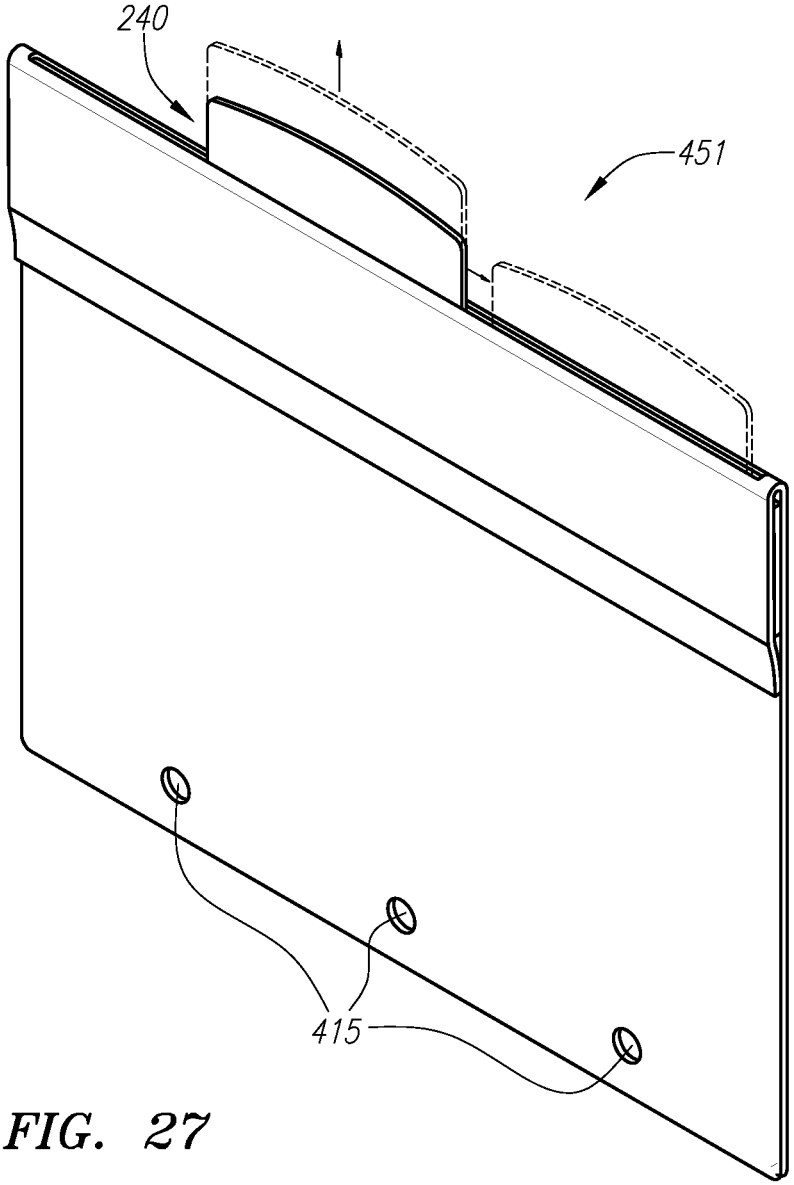
FIG. 27 is a front perspective view of a second embodiment of a divider constructed according to the present invention, the divider being shown with a slidable tab positioned in a first position, exemplary alternate tab positions being shown in phantom.

Referring now to FIG. 27, there is shown a front perspective view of a second embodiment of a divider constructed according to the present invention, the divider being represented generally by reference numeral 451. Divider 451 is similar in many respects to divider 411, the principal difference between the two dividers being that, whereas divider 411 includes sliding tab assembly 40, divider 451 includes sliding tab assembly 240. Tab 240 of divider 451 can be used in a corresponding manner to that discussed above in connection with file folder assembly 211.

In any event, it is to be appreciated that in connection with the particular exemplary embodiment(s) presented herein certain structural and/or functional features are described as being incorporated in defined elements and/or components. However, it is contemplated that these features can, to the same or similar benefit, also likewise be incorporated in other elements and/or components where appropriate. It is also to be appreciated that different aspects of the exemplary embodiments can be selectively employed as appropriate to achieve other alternative embodiments suited for desired applications, the other alternative embodiments thereby realizing the respective advantages of the aspects incorporated therein.

Additionally, it is to be appreciated that certain elements described herein as incorporated together can under suitable circumstances be stand-alone elements or otherwise divided. Similarly, a plurality of particular functions described as being carried out by one particular element can be carried out by a plurality of distinct elements acting independently to carry out individual functions, or certain individual functions can be split-up and carried out by a plurality of distinct elements acting in concert. Alternatively, some elements or components otherwise described and/or shown herein as distinct from one another can be physically or functionally combined where appropriate.

In short, the present specification has been set forth with reference to preferred embodiments. Obviously, modifications and alterations will occur to others upon reading and understanding the present specification. It is intended that the invention be construed as including all such modifications and alterations insofar as they come within the scope of the appended claims or the equivalents thereof.

We claim:

1. A file folder assembly comprising:

a file folder, the file folder having an edge slot positioned on an edge of the file folder; and a tab slidably disposed on the edge slot in a plurality of directions with respect to the edge slot, at least two of the plurality of directions being non-collinear with respect to one another such that the tab can be slidably disposed in the at least two of the plurality of directions independently on the edge.

2. The file folder assembly as claimed in claim 1, wherein the plurality of directions includes a horizontal direction and a vertical direction.

3. The file folder assembly as claimed in claim 1, wherein the file folder is a hinged folder that includes a front panel and a rear panel.

4. The file folder assembly as claimed in claim 1, wherein the file folder is selected from the group consisting of a single pocket folder, a multi-compartmented folder, a hanging file folder, and a folder.

5. The file folder assembly as claimed in claim 1, wherein the file folder includes a rear wall having a looped-over top portion, the looped-over top portion forming at least a portion of the edge slot, and the tab extending through the edge slot.

6. The file folder assembly as claimed in claim 1, further comprising a rail, the rail being fixedly mounted on the file folder, and the tab being slidably mounted on the rail.

7. The file folder assembly as claimed in claim 1, further comprising a rail and a coupling member, the rail being mounted on the file folder, and the tab being slidably coupled to the rail by the coupling member.

8. The file folder assembly as claimed in claim 7, wherein:
- the rail includes a first slot oriented in a first direction relative to the edge of the file folder;
- the tab includes a second slot oriented in a second direction relative to the edge of the file folder, and
- the coupling member includes a post inserted through both the first slot and the second slot to permit the tab to be slid selectively along at least one of the first direction and the second direction.

9. A file folder assembly comprising:
- a file folder, the file folder having an edge;
- a tab slidably disposed on the edge in a plurality of directions, at least two of the plurality of directions being non-collinear with respect to one another; and
- a rail and a coupling member, the rail being mounted on the file folder, and the tab being slidably coupled to the rail by the coupling member, wherein:
  - the rail includes a first strap oriented in a first direction;
  - the coupling member includes a second strap oriented in a second direction and a first plurality of slots;
  - the tab includes a second plurality of slots;
  - the first strap of the rail is woven through the first plurality of slots of the coupling member; and
  - the second strap of the coupling member is woven through the second plurality of slots of the tab.

10. A file folder assembly comprising:
- a file folder; and
- a sliding tab assembly coupled to the file folder, the sliding tab assembly including:
  - a rail fixedly mounted on the file folder, the rail including an elongated slot, the elongated slot extending in a first direction,
  - a tab, the tab including at least one elongated slot extending in a second direction, and
  - a coupling member, the coupling member including a first post, the first post being inserted through both the elongated slot in the rail and the elongated slot in the tab, the coupling member further including enlargements on opposite ends of the first post dimensioned to retain the first post in the elongated slot in the rail and in the elongated slot in the tab
- the sliding tab assembly being configured to slide in the first direction and the second direction independently on a transverse edge of the file folder.

11. The file folder assembly as claimed in claim 10, wherein one of the elongated slot in the rail and the elongated slot in the tab is oriented horizontally relative to the file folder and the other of the elongated slot in the rail and the elongated slot in the tab is oriented vertically relative to the file folder.

12. The file folder assembly as claimed in claim 11, wherein:
- the elongated slot in the rail is oriented horizontally relative to the file folder; and
- the elongated slot in the tab is oriented vertically relative to the file folder.

13. The file folder assembly as claimed in claim 10, wherein
- the tab includes a plurality of parallel elongated slots; and
- the coupling member further includes a second post having enlargements on opposite ends thereof, the first post being inserted through the elongated slot of the rail and a first elongated slot of the tab, the second post being inserted through the elongated slot of the rail and a second elongated slot of the tab.

14. The file folder assembly as claimed in claim 10, wherein the file folder is a hinged folder that includes a front panel and a rear panel.

15. The file folder assembly as claimed in claim 10, wherein the file folder is selected from the group consisting of a single pocket folder, a multi-compartmented folder, a hanging file folder, and a folder.

16. A file folder assembly comprising:
- a file folder; and
- a sliding tab assembly coupled to the file folder, the sliding tab assembly including:
  - a first elongated strap extending in a first direction, the first elongated strap having a first end, a second end, and an intermediate portion, the first and second ends of the first elongated strap being fixed to the file folder, the intermediate portion of the first elongated strap not being fixed to the file folder,
  - a coupling member, the coupling member including a second elongated strap and a first plurality of parallel slots, the second elongated strap extending in a second direction different than the first direction of the first elongated strap, the first elongated strap being woven through the first plurality of parallel slots of the coupling member in such a way as to permit the coupling member to slide along the first elongated strap, and
  - a tab, the tab including a second plurality of parallel slots, the second elongated strap of the coupling member being woven through the second plurality of parallel slots of the tab in such a way as to permit the tab to slide along the second elongated strap.

17. The file folder assembly as claimed in claim 16, wherein one of the first and second elongated straps is oriented horizontally relative to the file folder and the other of the first and second elongated straps is oriented vertically relative to the file folder.

18. The file folder assembly as claimed in claim 17, wherein:
- the first elongated strap is oriented horizontally relative to the file folder, and
- the second elongated strap is oriented vertically relative to the file folder.

19. The file folder assembly as claimed in claim 16, wherein the file folder is a hinged folder that includes a front panel and a rear panel.

20. The file folder assembly as claimed in claim 16, wherein the file folder is selected from the group consisting of a single pocket folder, a multi-compartmented folder, a hanging file folder, and a folder.

21. A divider, the divider comprising:
- a sheet, the sheet having at least one transverse opening and an edge, the edge having a transverse slot; and
- a tab slidably disposed in the transverse slot in a plurality of directions with respect to the transverse slot, at least two of the plurality of directions being non-collinear with respect to one another such that the tab can be slidably disposed in the at least two of the plurality of directions independently on the edge of the sheet.

22. The divider as claimed in claim 21, wherein the plurality of directions includes a horizontal direction and a vertical direction.

23. The divider as claimed in claim 21, wherein the sheet includes a looped-over top portion, the looped-over top portion forming at least a portion of the transverse slot, the tab extending through the transverse slot.

24. The divider as claimed in claim 21, further comprising a rail, the rail being fixedly mounted on the sheet, the tab being slidably mounted on the rail.

25. The divider as claimed in claim 21, further comprising a rail and a coupling member, the rail being mounted on the sheet, the tab being slidably coupled to the rail by the coupling member.

26. The divider as claimed in claim 25, wherein:

the rail includes a first slot oriented in a first direction relative to the sheet, the tab includes a second slot oriented in a second direction relative to the sheet, and the coupling member includes a post inserted through both the first slot and the second slot to permit the tab to be slid selectively along at least one of the first direction and the second direction.

27. A divider, the divider comprising:

a sheet, the sheet having at least one transverse opening;

a tab slidably disposed on the sheet in a plurality of directions, at least two of the plurality of directions being non-collinear with respect to one another; and a rail and a coupling member, the rail being mounted on the sheet, the tab being slidably coupled to the rail by the coupling member, wherein:

the rail includes a first strap oriented in a first direction, the coupling member includes a second strap oriented in a second direction and a first plurality of slots, the tab includes a second plurality of slots, the first strap of the rail is woven through the first plurality of slots of the coupling member, and the second strap of the coupling member is woven through the second plurality of slots of the tab.

28. The divider as claimed in claim 21, wherein the sheet has a plurality of transverse openings.

* * * * *